US006934496B2

(12) United States Patent
Sakuma et al.

(10) Patent No.: US 6,934,496 B2
(45) Date of Patent: Aug. 23, 2005

(54) DEVELOPING DEVICE CONVEYING TONER USING A TRAVELING-WAVE ELECTRIC FIELD AND IMAGE FORMING APPARATUS USING SAME

(75) Inventors: Masamitsu Sakuma, Hirakata (JP); Katsumi Adachi, Nara (JP); Taisuke Kamimura, Kitakatsuragi-gun (JP); Kiyoshi Toizumi, Nara (JP); Toshimitsu Gotoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/399,210

(22) PCT Filed: Jun. 27, 2002

(86) PCT No.: PCT/JP02/06498

§ 371 (c)(1),
(2), (4) Date: Apr. 11, 2003

(87) PCT Pub. No.: WO03/003126

PCT Pub. Date: Jan. 9, 2003

(65) Prior Publication Data

US 2004/0037593 A1 Feb. 26, 2004

(30) Foreign Application Priority Data

Jun. 28, 2001 (JP) ..... 2001-196826
Jun. 29, 2001 (JP) ..... 2001-198910

(51) Int. Cl.[7] ..... G03G 15/08
(52) U.S. Cl. ..... 399/265; 399/266
(58) Field of Search ..... 399/252, 265, 399/266, 289, 290, 291; 347/141

(56) References Cited

U.S. PATENT DOCUMENTS 4,568,955 A * 2/1986 Hosoya et al.
4,598,991 A 7/1986 Hosoya et al. ..... 399/266
4,962,723 A * 10/1990 Hotomi ..... 399/266
5,210,551 A * 5/1993 Inoue et al. ..... 347/141
5,999,780 A * 12/1999 Mort et al. ..... 399/266
6,104,904 A 8/2000 Snelling ..... 399/265

FOREIGN PATENT DOCUMENTS

| | | | |
|---|---|---|---|
| EP | 0 762 231 | | 3/1997 |
| EP | 2002-91160 | | 3/2002 |
| EP | 1 400 868 | | 3/2004 |
| JP | 05-035075 | * | 2/1993 |
| JP | 6-5396 | * | 1/1994 |
| JP | 2836537 | | 10/1998 |
| JP | 11-249430 | * | 9/1999 |
| JP | 2001-122436 | | 5/2001 |
| JP | 2002-91160 | * | 3/2002 |
| JP | 2002-99143 | * | 4/2002 |
| JP | 2002-214910 | * | 7/2002 |

* cited by examiner

*Primary Examiner*—Hoan Tran
(74) *Attorney, Agent, or Firm*—David G. Conlin; William J. Daley, Jr.; Edwards & Angell, LLP

(57) ABSTRACT

A developing device is provided with a developer conveying member in which a plurality of electrodes arranged on a substrate at a predetermined interval are coated with a surface protection layer, the developer conveying member being provided in a developing area that faces an image carrying body whose surface carries an electrostatic latent image, wherein developer is conveyed on the developer conveying member using a traveling-wave electric field that is formed by applying a polyphase voltage to the respective electrodes. The developing device is further provided with a supplying member for supplying the developer onto the developer conveying member, wherein (i) an effective electrode width Le of the respective electrodes in their width direction orthogonal to their arranging direction and (ii) a width Lt of a developer existing area on the supplying member, the width Lt being orthogonal to a direction of supplying the developer, are set so as to satisfy a relation of Lt<Le. This prevents the developer from entering wiring pattern areas outside of the electrodes on the developer conveying member, thereby surely preventing the scattering and the sticking of the developer in the areas.

17 Claims, 18 Drawing Sheets

FIG. 15

| | PROPERTY OF CONVEYING TONER | | DOT SCATTERING | | OVERALL JUDGEMENT | |
|---|---|---|---|---|---|---|
| Vpp/ λ | COUNTER ROTATION | WITH ROTATION | COUNTER ROTATION | WITH ROTATION | COUNTER ROTATION | WITH ROTATION |
| 0.5 | × | × | ◎ | ◎ | × | × |
| 1 | △ | △ | ○ | ◎ | △ | ○ |
| 2 | ○ | ○ | △ | ◎ | ○～△ | ○ |
| 3 | ○ | ○ | × | ◎ | △ | ◎ |
| 4 | ◎ | ◎ | × | ◎ | × | ◎ |
| 5 | ◎ | ◎ | × | ○ | × | ◎ |
| 6 | ◎ | ◎ | × | △ | × | ○ |
| 7 | × (LEAKAGE OCCURS) | × (LEAKAGE OCCURS) | × | △ | × | × |

◎:VERY GOOD, ○:GOOD, △:POOR, ×:VERY POOR

SCATTERING; ◎

SCATTERING; ○

SCATTERING; ×

DEVELOPING DEVICE CONVEYING TONER USING A TRAVELING-WAVE ELECTRIC FIELD AND IMAGE FORMING APPARATUS USING SAME

TECHNICAL FIELD

The present invention relates to a developing device for developing an electrostatic latent image that is formed on a latent image carrying body (image carrying body) using developer, etc., and an image forming apparatus adapting the same; and in particular relates to a developing device employing a mechanism for conveying the developer using a traveling-wave electric field (electric field curtain), and an image forming apparatus adapting the same.

BACKGROUND ART

As a developing device adapted in an image forming apparatus using an electrophotgraphy process, such as a copying machine, a printer, and a facsimile machine, a developing device of a noncontact method, in which the development is performed without contacting a developer carrying body with an image carrying body, has come to receive attention. Suggested therein are methods using a powder cloud method, a jumping method, and a method using an electric field curtain (traveling-wave electric field).

The means to generate the electric field curtain is disclosed in Japanese Unexamined Patent Publication No. 9-68864/1997 (Tokukaihei 9-68864, published on Mar. 11, 1997), for example. This means is arranged so as to include a supporting substrate made of metal or resin, an insulation layer layered on the supporting substrate, and plural sets of three electrodes for generating an electric field curtain effect which are sequentially buried in the insulation layer, wherein the developer is conveyed on a surface of a developer conveying member using the traveling-wave electric field that is formed by applying a polyphase voltage to the respective electrodes.

Incidentally, in the developing device using the traveling-wave electric field, wiring patterns are respectively provided outside of the electrodes on the developer conveying member in the width direction of the electrodes orthogonal to the arranging direction of the electrodes (on both sides of the developer conveying member in a width direction orthogonal to a conveying direction).

In this case, conditions for generating the traveling-wave electric field are not met in areas where the wiring patterns are provided, because the areas are located outside of the electrodes. Thus, when the developer enters these areas, scattering and sticking of the developer may occur.

Incidentally, in the developing device using the traveling-wave electric field, the developer is conveyed in a predetermined direction on the developer conveying member. In this case, when the developer is conveyed in an opposite direction (counter direction) to a moving direction of the image carrying body which moves an electrostatic latent image in a circumferential direction, the moving speed of the developer in a developing area that faces the image carrying body becomes relatively fast with respect to the moving speed of the image carrying body.

This increases a collision energy for landing the developer on the image carrying body. Thus, when the developer lands at a portion on the image carrying body where the developer has already existed, the scattering of the developer may occur, thereby causing an adverse effect on the image.

Further, in the developing device as described above, the applied voltage applied to the respective electrodes is increased for increasing an amount of the developer conveyed on the developer conveying member and for reducing the occurrence of the sticking of the developer.

In this case, when the developer is conveyed in the counter direction with respect to the moving direction of the image carrying body, the increase of the applied voltage to the respective electrodes increases a speed of conveying the developer, so as to further relatively increase the moving speed of the developer in the developing area with respect to the moving speed of the image carrying body. This makes it further difficult for the developer to land on the image carrying body, so as to frequently cause the scattering, thereby causing an adverse effect on the image.

In view of the foregoing problem, the object of the present invention is to provide a developing device capable of preventing the developer from entering the wiring pattern areas outside of the electrodes on the developer conveying member, and capable of surely preventing the scattering and the sticking of the developer in the areas, and an image forming apparatus adapting the same.

In view of the foregoing problem, the object of the present invention is to provide a developing device capable of landing the developer softly on the image carrying body without scattering so as to form a stable image, and an image forming apparatus adapting the same.

DISCLOSURE OF INVENTION

In order to attain the foregoing object, a developing device of the present invention, including a developer conveying member in which a plurality of electrodes arranged on a substrate at a predetermined interval are coated with a surface protection layer, the developer conveying member being provided in a developing area that faces an image carrying body whose surface carries an electrostatic latent image, wherein developer is conveyed on the developer conveying member using a traveling-wave electric field that is formed by applying a polyphase voltage to the respective electrodes, is provided with a supplying member for supplying the developer onto the developer conveying member. Further, (i) an effective electrode width Le of the respective electrodes in their width direction orthogonal to their arranging direction and (ii) a width Lt of a developer existing area on the supplying member, the width Lt being orthogonal to a direction of supplying the developer, are set so as to satisfy a relation of $Lt<Le$.

With this specific feature, the width Lt of the developer existing area on the supplying member (the width Lt is orthogonal to the arranging direction of the respective electrodes) is smaller than the effective electrode width Le of the respective electrodes in their width direction (orthogonal to their arranging direction). This prevents the developer from entering the wiring pattern areas outside of the electrodes in their width direction, thereby surely preventing the scattering and the sticking of the developer in the areas.

In order to attain the foregoing object, the present invention premises a developing device, including a developer conveying member in which a plurality of electrodes arranged on a substrate at a predetermined interval are coated with a surface protection layer, the developer conveying member being provided in a developing area that faces an image carrying body whose surface carries an electrostatic latent image, wherein developer is conveyed on the developer conveying member using a traveling-wave electric field that is formed by applying a polyphase voltage to the respective electrodes. Then, a direction of conveying the developer is set to be the same as a direction of moving the image carrying body that moves the electrostatic latent image in a circumferential direction.

With this specific feature, since the developer is conveyed in the same direction ("with" direction) with respect to the direction of moving the image carrying body that moves the electrostatic latent image in the circumferential direction, the moving speed of the developer in the developing area that faces the image carrying body becomes relatively slow with respect to the moving speed of the image carrying body. This decreases the collision energy for landing the developer on the image carrying body. Thus, even when the developer lands at the portion on the image carrying body where the developer has already existed, the scattering of the developer does not occur. This eliminates the adverse effect on the image, thereby forming a stable image.

Further, when the applied voltage applied to the respective electrodes is increased for increasing an amount of the developer conveyed on the developer conveying member and for reducing the occurrence of the sticking of the developer, the developer may be conveyed in the "with" direction with respect to the direction of moving the image carrying body. With this arrangement, in spite of the fact that the increased applied voltage applied to the respective electrodes increases the speed of conveying the developer, the moving speed of the developer in the developing area becomes relatively slow with respect to the moving speed of the image carrying body. This enables the developer to land softly on the image carrying body so as to prevent the scattering of the developer, thereby forming a stable image.

For a fuller understanding of the nature and advantages of the invention, reference should be made to the ensuing detailed description taken in conjunction with the accompanying drawings.

BRIEF DESCRIPTION OF THE DRAWINGS

FIG. 15 is a table showing judgment results which are bases for determining a range of a value $Vpp/\lambda$ that is obtained by dividing the applied voltage Vpp to respective electrodes by an interelectrode pitch $\lambda$ in the developing device shown in FIG. 10.

FIG. 16(*b*) is a diagram showing a state in which a little occurring of the dot scattering disturbs an image a little.

FIG. 16(*c*) is a diagram showing a state in which frequent occurring of the dot scattering disturbs the image.

BEST MODE FOR CARRYING OUT INVENTION

Although the present invention is detailed as follows based on embodiments, the present invention is not limited to them.

[Embodiment 1]

The following will explain an embodiment of the present invention.

Figure 1:
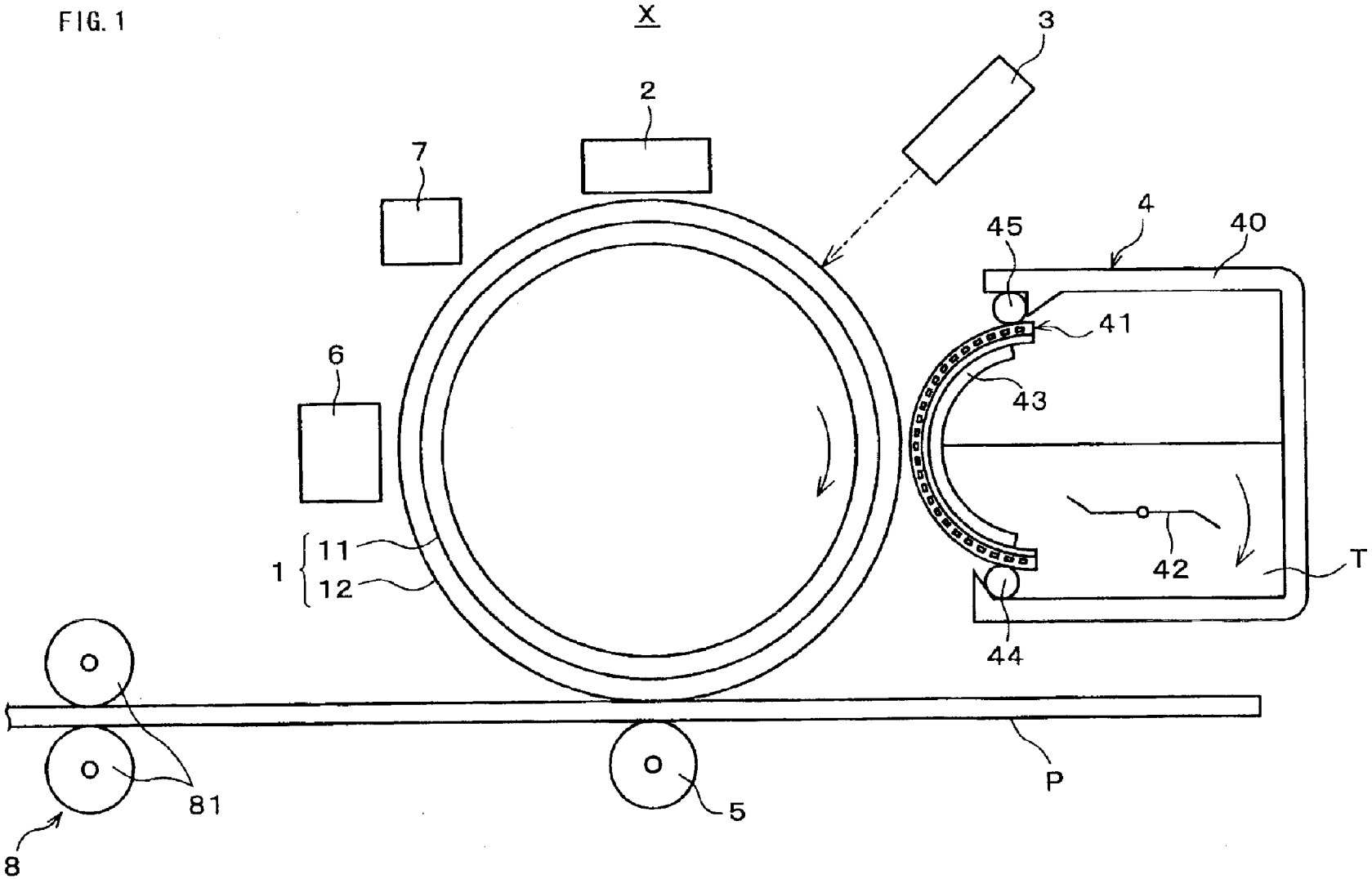
FIG. 1 is a diagram schematically showing an image forming apparatus employing an electrophotography method, which adapts a developing device in accordance with Embodiment 1 of the present invention.

FIG. 1 shows an image forming apparatus adapting a developing device in accordance with Embodiment 1 of the present invention. Inside the image forming apparatus X, a cylindrical photosensitive drum 1 is provided as an image carrying body. Around the photosensitive drum 1 at the center, an electrically charging member 2, an exposing member 3, a developing device 4, a transfer member 5, a cleaning member 6, and an electrically discharging member 7 are sequentially arranged. Further, a paper conveyance route for conveying paper P is provided between the photosensitive drum 1 and the transfer member 5. On a downstream side of the photosensitive drum 1 with respect to a conveying direction of the paper conveyance route, a fixing device 8 having a pair of upper and lower fixing rollers 81 is provided.

In an electrophotography process, an image is formed in a following manner. An electrostatic latent image is formed on the photosensitive drum 1 in accordance with an original image or data from a host computer (not shown), and the electrostatic latent image is made visible by the developing device and transferred on the paper P.

In the photosensitive drum 1, a photoconductive layer 12 is formed on a substrate 11. The photosensitive drum 1 can be rotated so as to go past the arranged members 3 through 7 in their arranged order starting from the electrically charging member 2. First, a surface of the photosensitive drum 1 (photoconductive layer 12) is charged to a predetermined potential by the electrically charging member 2. The surface of the photosensitive drum 1, which is charged to be at the predetermined potential, reaches a position of the exposing member 3 in accordance with the rotation of the photosensitive drum 1. Based on image information, the exposing member 3, which is writing means, writes an image on the photosensitive drum 1 that is charged with light such as a laser, for example. This forms the electrostatic latent image on the photosensitive drum 1. The surface of the photosensitive drum 1, which is formed with the electrostatic latent image, reaches a position of the developing device 4 in accordance with the rotation of the photosensitive drum 1.

The developing device 4 develops the electrostatic latent image on the surface of the photosensitive drum 1 into a toner image using toner T (developer) that is conveyed on a toner conveying member (developer conveying member) 41. The surface of the photosensitive drum 1, which supports the toner image, reaches a position of the transfer member 5 in accordance with the rotation of the photosensitive drum 1.

The transfer member 5 transfers the toner image on the surface of the photosensitive drum 1 onto the paper P. The toner image, which is transferred from the photosensitive drum 1 onto the paper P, is fixed on the paper P by the fixing device 8.

The surface of the photosensitive drum 1 after the toner image is transferred reaches a position of the cleaning member 6 in accordance with the rotation of the photosensitive drum 1. The cleaning member 6 removes the toner T or paper powder that remains on the surface of the photosensitive drum 1. The surface of the photosensitive drum 1, which has been cleaned by the cleaning member 6, reaches a position of the electrically discharging member 7 in accordance with the rotation of the photosensitive drum 1. The electrically discharging member 7 removes a potential remaining on the surface of the photosensitive drum 1. The above-described sequential operations compose a single image forming process.

The photosensitive drum 1 may be arranged so that the photoconductive layer 12 such as amorphous silicon (a-Si), selenium (Se), and organic photo semiconductor (OPC) is formed into a thin film on an outer circumferential surface of the substrate 11 such as a metal drum made of aluminum, etc., but the arrangement is not particularly limited to this.

The electrically charging member 2 may be, but not limited to, a charging line such as a tungsten wire, a corona charger made of a metal shield plate, a metal grid plate, etc., a charging roller, and a charging brush.

The exposing member 3 may be, but not limited to, a semiconductor laser and a light emitting diode.

The transfer member 5 may be, but not limited to, a corona transcriber, a transfer roller, and a transfer brush.

The cleaning member 6 may be, but not limited to, a cleaning blade.

The electrically discharging member 7 may be, but not limited to, a discharging lamp.

The present embodiment adapts the arrangement in which the toner conveying member 41 and the photosensitive drum 1 have a predetermined space therebetween, so that the electrostatic latent image on the surface of the photosensitive drum 1 is developed without being contacted. However, the present invention is not limited to this arrangement, and may adapt an arrangement in which contact development is carried out by contacting the toner conveying member with the surface of the photosensitive drum.

Figure 2:
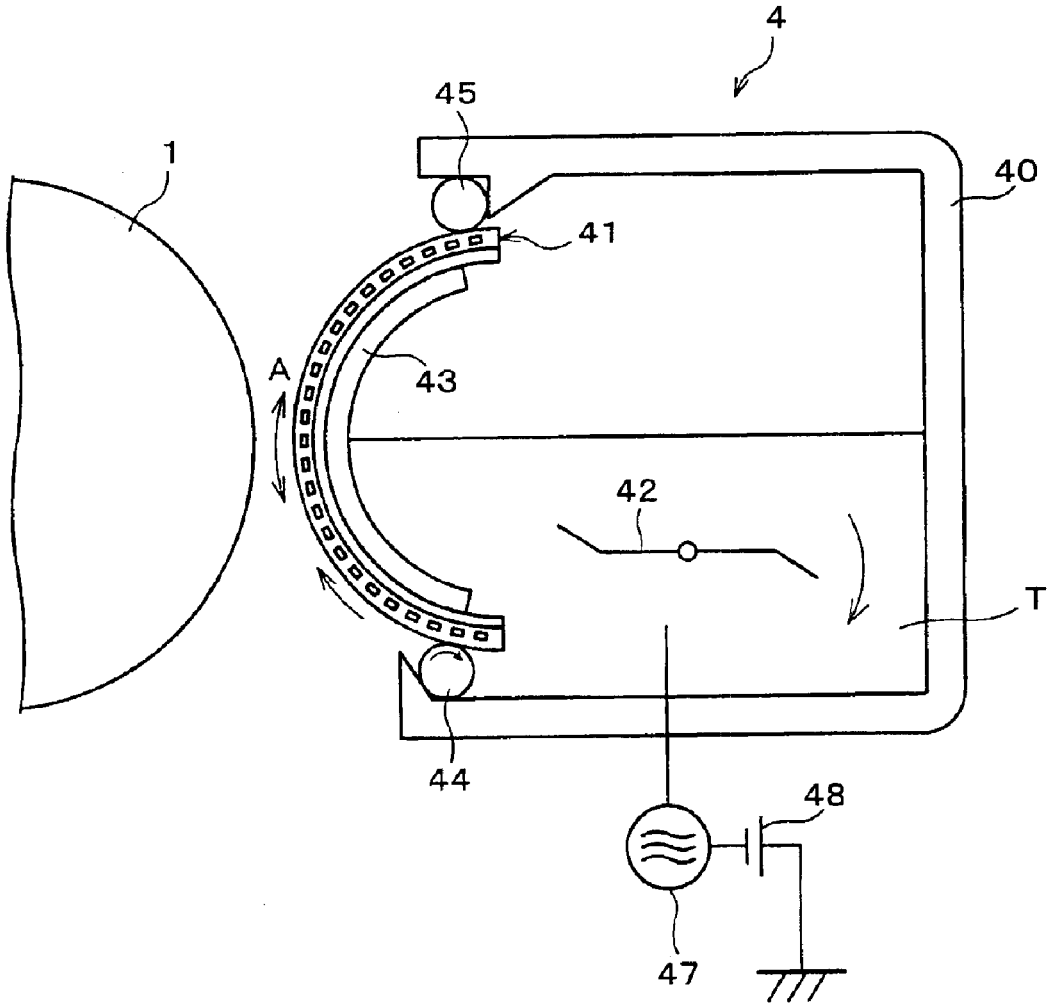
FIG. 2 is a diagram schematically showing an arrangement of the developing device shown in FIG. 1.

As shown in FIG. 2, the developing device 4 is provided with a casing 40, the toner conveying member 41, and a mixing paddle 42. The casing 40 stores the toner T inside. The mixing paddle 42 mixes the toner T that is stored in the casing 40.

The toner conveying member 41 is in a belt shape so as to form a substantial plane shape that faces a developing area A of the photosensitive drum 1. Note that, in the present embodiment, the toner conveying member 41 in the belt shape is shown, but the shape of the toner conveying member 41 is not limited to this, but may be in a semicircular shape, for example.

Further, the toner conveying member 41 is provided with slight inclination with respect to a vertical direction of the developing device 4 so as to be substantially parallel to a tangent of the developing area A on the surface of the photosensitive drum 1. Further, in order to retain this position, the belt-shaped toner conveying member 41 is provided with a supporting member 43 for supporting the toner conveying member 41 on an opposite surface of the surface for conveying the toner T.

At a lower edge portion of the toner conveying member 41, a supplying member 44 is provided for supplying the toner T to be conveyed on the surface of the toner conveying member 41. On the other hand, at an upper edge portion of the toner conveying member 41, a collecting member 45 is provided for collecting the toner T on the surface of the toner conveying member 41.

Further, a polyphase AC power supply 47 and a developing bias power supply 48 are connected in series to the toner conveying member 41. The supplying member 44 and the collecting member 45 are both in a cylindrical shape, for example, and respectively contact the surface of the belt-shaped toner conveying member 41 so as to be rotated.

The supplying member 44 supplies to the toner conveying member 41, the toner T that is stored in the casing 40. The material of the supplying member 44 may be, but not limited to, solid rubber and foamed rubber such as silicone, urethane, and EPDM (ethylene-propylene-diene-methylene copolymer), for example. Further, the supplying member 44 may have conductivity by adding carbon black or an ionic conductive agent (and may be applied with a voltage). The supplying member 44 may have a function of charging the toner T, by appropriately setting (a) contact pressure of the supplying member 44 and the toner conveying member 41, or (b) a voltage value to be applied to the supplying member 44. Alternatively, the toner may be charged by providing a sheet-shaped blade (the material may be the same as the supplying member 44), for example, before the supplying member 44.

The collecting member 45 collects and returns into the developing device 4 the toner T that does not contribute to the development of the electrostatic latent image on the photosensitive drum 1. The material of the collecting member 45 is not particularly limited, but may be the same as that of the supplying member 44.

The supporting member 43 retains the belt-shaped toner conveying member 41 to be in the state facing the developing area A of the photosensitive drum 1. The arrangement of the supporting member 43 is not particularly limited, but the supporting member 43 may be composed of ABS (Acrylonitrile-Butadiene-Styrene) resin.

Figure 3:
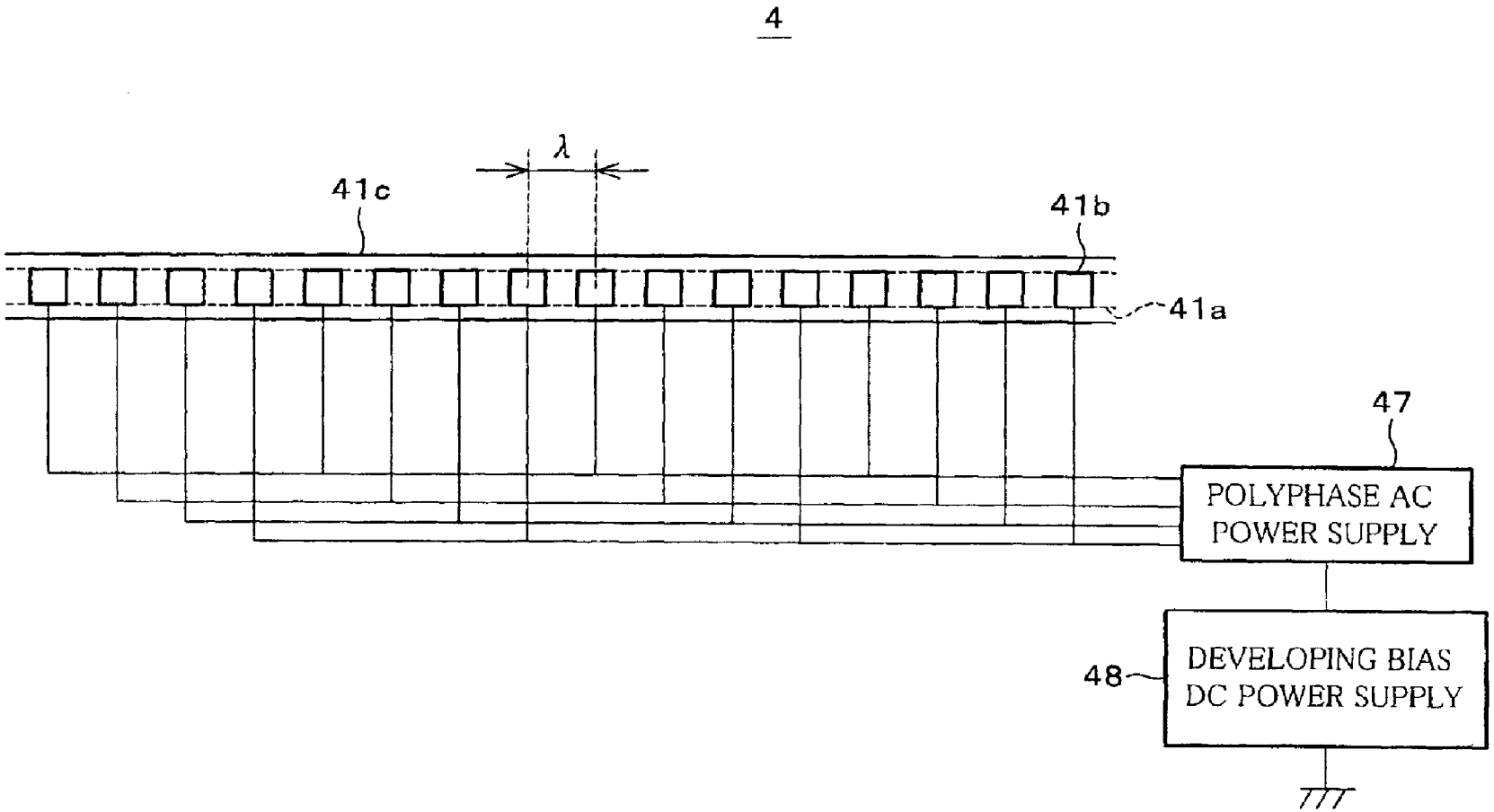
FIG. 3 is a diagram schematically showing an arrangement of a toner conveying member of the developing device shown in FIG. 1.

The toner conveying member 41 conveys the toner T using the electric field curtain effect. As shown in FIG. 3, in the toner conveying member 41, plural sets of four traveling-wave generating electrodes 41*b* for generating the electric field curtain effect are sequentially provided on a substrate

41*a* that is composed of an insulation layer. A surface protection layer 41*c* covers a surface side of the toner conveying member 41. Then, the polyphase AC power supply 47 for toner conveyance applies a polyphase AC voltage to these electrodes 41*b*, so as to generate the electric field curtain in a direction parallel to the surface of the toner conveying member 41, thereby conveying the toner T to the developing area A using the electric field curtain effect. In this case, each of the traveling-wave generating electrodes 41*b* is a microelectrode having a width of 40 μm through 250 μm, and the traveling-wave generating electrodes 41*b* are respectively provided in parallel to one another with a pitch of 50 dpi (dot per inch) through 300 dpi, namely approximately 500 μm through 85 μm.

Figure 4:
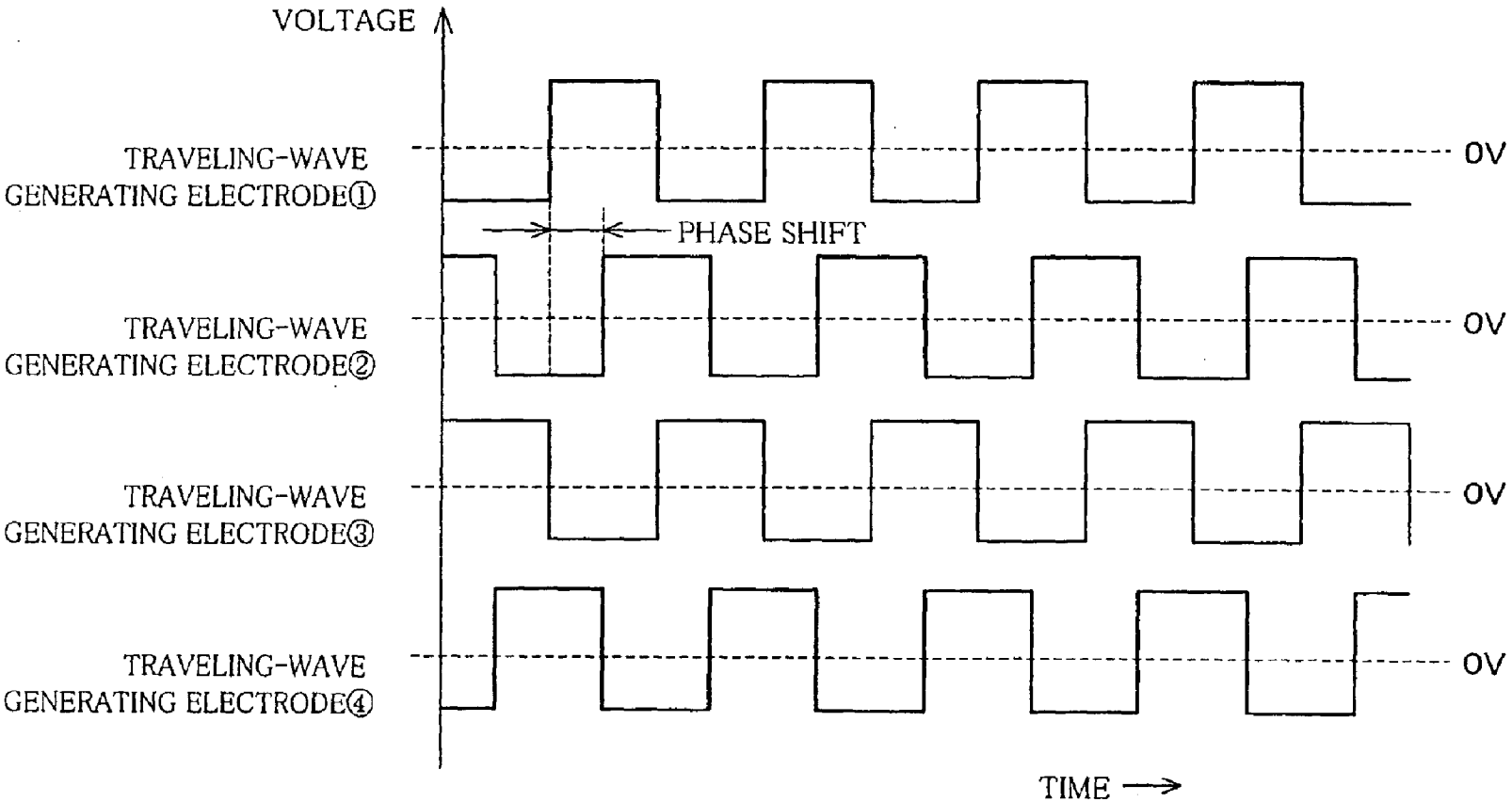
FIG. 4 is a waveform chart showing waveforms of voltages applied on the toner conveying member of the developing device shown in FIG. 1.

As a concrete example, the toner conveying member 41 may be arranged so that the substrate 41*a* is made of polyimide (having a thickness of 25 μm), the traveling-wave generating electrode 41*b* is made of copper (having a thickness of 18 μm), and the surface protection layer 41*c* is made of polyimide (having a thickness of 25 μm). Note that, in the present embodiment, four-phase alternating voltages having voltage waveforms as shown in FIG. 4, for example, are respectively applied to the set of four traveling-wave generating electrodes 41*b*, so as to generate a traveling-wave electric field on the traveling-wave generating electrodes 41*b*, but the present invention is not particularly limited to this arrangement. Three-phase alternating voltages may be applied to a set of three traveling-wave generating electrodes. Further, it is preferable that a bias voltage (developing bias) is applied so as to form a developing electric field between the photosensitive drum 1 and the toner conveying member 41.

The voltage waveform may be a sine wave, a trapezoidal wave, etc. A range of the voltage value is preferably 100V through 3 kV, for example, so as not to generate dielectric breakdown between the respective traveling-wave generating electrodes 41*b*. A range of the frequency is preferably 100 Hz through 5 kHz. Note that, the voltage value and the frequency are not particularly limited, and may be appropriately set in accordance with a shape of the traveling-wave generating electrode elements, a conveying speed of the toner T, a material of the toner T, and the like.

Figure 5:
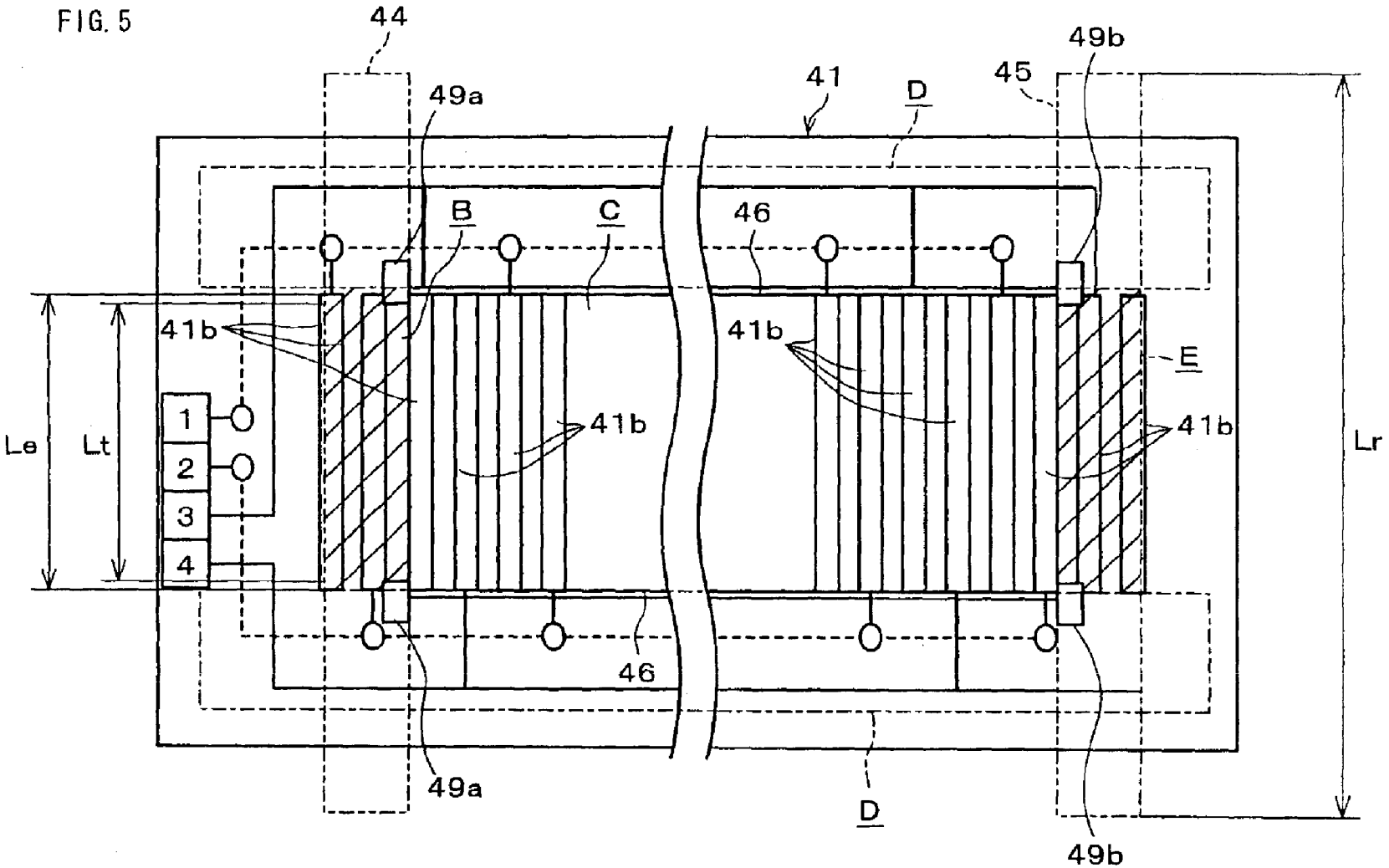
FIG. 5 is a plan view showing the arrangement of the toner conveying member of the developing device shown in FIG. 1.
Figure 6:
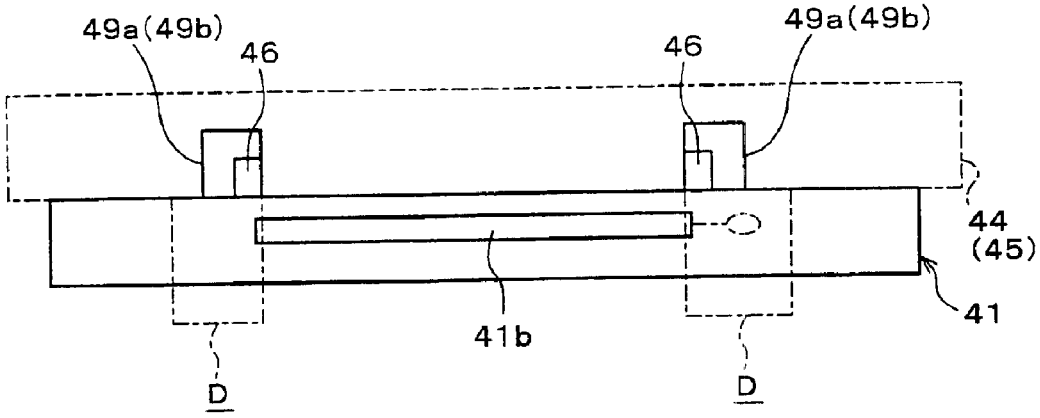
FIG. 6 is a diagram showing the arrangement of the toner conveying member of the developing device shown in FIG. 1, which is seen from a direction of conveying toner.

As a characterizing portion of the present invention, as shown in FIGS. 5 and 6, (i) an effective electrode width Le of the respective traveling-wave generating electrodes 41*b* in their width direction (vertical direction in FIGS. 5 and 6) orthogonal to their arranging direction, (ii) a width Lt of a toner existing area B on the supplying member 44, the width Lt (in the vertical direction in FIGS. 5 and 6) being orthogonal to a direction of supplying the toner, and (iii) a width Lr of the collecting member 45, the width Lr (in the vertical direction in FIGS. 5 and 6) being orthogonal to a direction of collecting the toner, are set so as to satisfy the equation of:

$$Lt<Le\leqq Lr.$$

Further, a toner conveying area C is located between the supplying position and the collecting position of the toner T on the toner conveying member 41, and wiring pattern areas D are respectively provided outside of the traveling-wave generating electrodes 41*b* in their width direction. At respective boundaries of the both areas C and D, a wall 46 is provided for parting the both areas C and D.

Further, the supplying member 44 contacts the toner conveying member 41 at the toner existing area B. A seal member 49*a* for sealing the toner T is provided at each of both the edges of the toner existing area B in the width direction on the supplying member 44. Likewise, the collecting member 45 contacts the toner conveying member 41 at a toner existing area E. A seal member 49*b* for sealing the toner T is provided at each of both the edges of the toner existing area E in a width direction (vertical direction in FIGS. 5 and 6) on the collecting member 45.

As described above, in the present embodiment, the width Lt of the toner existing area B on the supplying member 44 (in the width direction of the respective traveling-wave generating electrodes 41*b*), and the effective electrode width Le of the respective traveling-wave generating electrodes 41*b* in their width direction (direction orthogonal to their arranging direction) are set so as to satisfy the relation of Lt<Le, so that the width Lt of the toner existing area B on the supplying member 44 is smaller than the effective electrode width Le of the respective traveling-wave generating electrodes 41*b*. This prevents the toner T from entering the wiring pattern areas D which are respectively located outside of the traveling-wave generating electrodes 41*b* in their width direction, thereby surely preventing the scattering and the sticking of the toner in the respective wiring pattern areas D.

Further, the width Lr of the collecting member 45 is set so as to satisfy the relation of Le≦Lr. With the width Lr of the collecting member 45 which is larger than the effective electrode width Le of the respective traveling-wave generating electrodes 41*b*, the collecting member 45 can surely collect the toner T that is conveyed within the effective electrode width Le, thereby preventing the toner from accumulating in the toner conveying area C on the toner conveying member 41.

Further, at the respective boundaries of the toner conveying area C on the toner conveying member 41 and the wiring pattern areas D that are respectively provided outside of the traveling-wave generating electrodes 41*b* in their width direction, the wall 46 is provided for parting the both areas C and D. With this arrangement, the wall 46 can block the toner T that is conveyed in the toner conveying area C on the toner conveying member 41 so as not to enter the wiring pattern areas D, thereby surely preventing the scattering and the sticking of the toner T from occurring.

Further, at each of both the edges of the toner existing area B in the width direction on the supplying member 44, the seal member 49*a* is provided for sealing the toner T, thereby preventing the toner T from entering the wiring pattern areas D outside of the traveling-wave generating electrodes 41*b*. Likewise, at each of both the edges of the toner existing area B in the width direction on the collecting member 45, the seal member 49*b* is provided for sealing the toner T, thereby preventing the toner from entering the wiring pattern areas D even when the conveyed toner T is defectively collected. This surely prevents the scattering and the sticking of the toner T.

Further, by adapting the above-described developing device 4 in the image forming apparatus X, it is possible to provide an image forming apparatus X capable of preventing the toner T from entering the wiring pattern areas D outside of the traveling-wave generating electrodes 41*b*, thereby surely preventing the scattering and the sticking of the toner T.

Note that, in Embodiment 1, (i) the effective electrode width Le of the respective traveling-wave generating electrodes 41*b* in their width direction, (ii) the width Lt of the toner existing area B on the supplying member 44, and (iii) the width Lr of the collecting member 45 are set so as to satisfy the relation of Lt<Le≦Lr; the wall 46 is provided at the respective boundaries of the toner conveying area C on the toner conveying member 41 and the wiring pattern areas D outside of the traveling-wave generating electrodes 41*b* in their width direction; and the seal members 49*a* and 49*b* are provided on the supplying member 44 and on the collecting member 45, respectively, at their respective both edges of the toner existing area B in the width direction. However, the conditions may be set in any combination, as long as at least (i) the effective electrode width Le of the respective traveling-wave generating electrodes 41*b* in their width direction and (ii) the width Lt of the toner existing area B on the supplying member 44 are set so as to satisfy the relation of Lt<Le. Further, the effective electrode width Le of the respective traveling-wave generating electrodes 41*b* in their width direction and the width Lr of the collecting member 45 may be set so as to satisfy the relation of Le≦Lr.

[Embodiment 2]

The following will explain another embodiment of the present invention.

In Embodiment 2, the developing device is provided with an endless belt which is driven at a very slow speed on the toner conveying member in the direction of conveying the toner. Note that, since the structure members other than the endless belt are the same as those of Embodiment 1, identical numbers with those used in Embodiment 1 are assigned, thus their explanation is omitted here.

Figure 7:
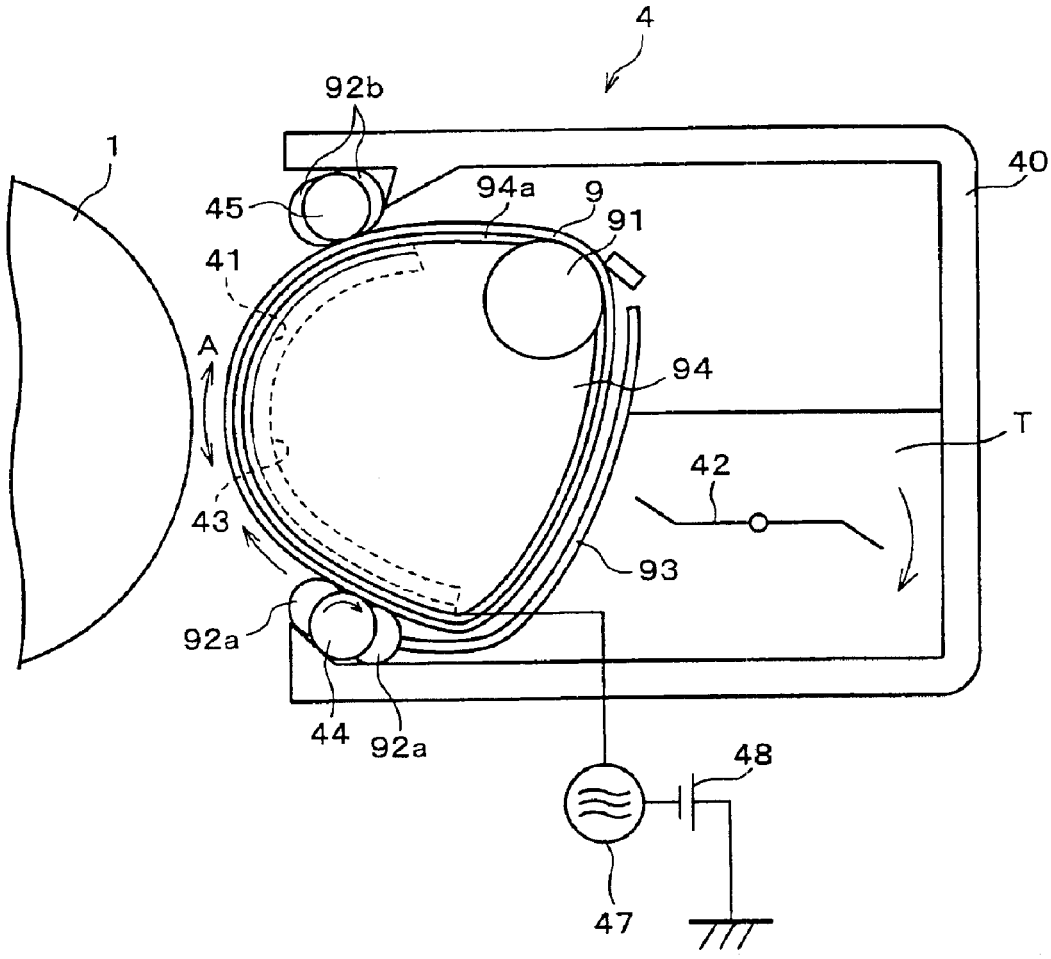
FIG. 7 is a diagram schematically showing an arrangement of a developing device in accordance with Embodiment 2 of the present invention.

Namely, in Embodiment 2, as shown in FIG. 7, an endless belt 9 is provided on the surface (counter surface to the photosensitive drum 1) of the toner conveying member 41 so as to cover the surface of the toner conveying member 41 in a circumferential direction. The endless belt 9 is driven at a predetermined peripheral speed by a driving roller 91 that is provided in the casing 40 of the developing device 4.

As described above, by driving the endless belt 9 at the predetermined peripheral speed, the surface of the toner conveying member 41 is continuously cleared, thereby preventing the sticking of the toner T and charging on the surface.

In this case, the speed of driving the endless belt 9 is set to be about one-tenth through one-hundredth of the speed of conveying the toner T, for example. The speed of driving the endless belt 9 can be measured by providing two infrared sensors so as to respectively detect time when the toner T reaches, or by using a high-speed video camera, for example.

Further, predetermined tension is applied to the endless belt 9 so as to closely contact the surface of the toner conveying member 41, so that the traveling-wave electric field (electric field curtain) formed by the traveling-wave generating electrodes 41*b* uniformly effects the surface of the toner conveying member 41.

The applicable endless belt 9 may be organic insulation materials such as polyimide, PET (polyethylene terephthalate), polytetrafluoroethylene, polyfluoroethylenepropylene, and PTFE (polytetrafluoroethylene), and rubber materials such as silicone, isoprene, and butadiene.

The thickness of the endless belt 9 may depend on an interelectrode pitch of the toner conveying member 41, but is preferably 5 μm through 200 μm, and more preferably 10 μm through 100 μm.

Further, the driving roller 91 may be a metal roller member such as SUS and iron, or the metal roller member as a core whose surface is coated with a member such as rubber, film, and sponge.

The supplying member 44 supplies the toner T to be conveyed on the surface of the endless belt 9, whereas the collecting member 45 collects the toner T on the surface of the endless belt 9.

Then, the polyphase AC power supply 47 applies the polyphase AC voltage to the respective traveling-wave generating electrodes 41*b*, so as to generate the electric curtain on the endless belt 9 in a direction parallel to the endless belt 9, thereby conveying the toner T to the developing area A using the electric field curtain effect.

In this case, even when the toner T is stuck on the surface of the toner conveying member 41, the toner is moved by the endless belt 9 which is driven at a very slow speed on the surface of the toner conveying member 41. Thus, even when the conveyance of the toner T stops at an area directly above the toner conveying member 41, the endless belt 9 conveys the toner T to an area having strong electric field intensity so as to resume the conveyance, thereby smoothly conveying the toner T.

Figure 8:
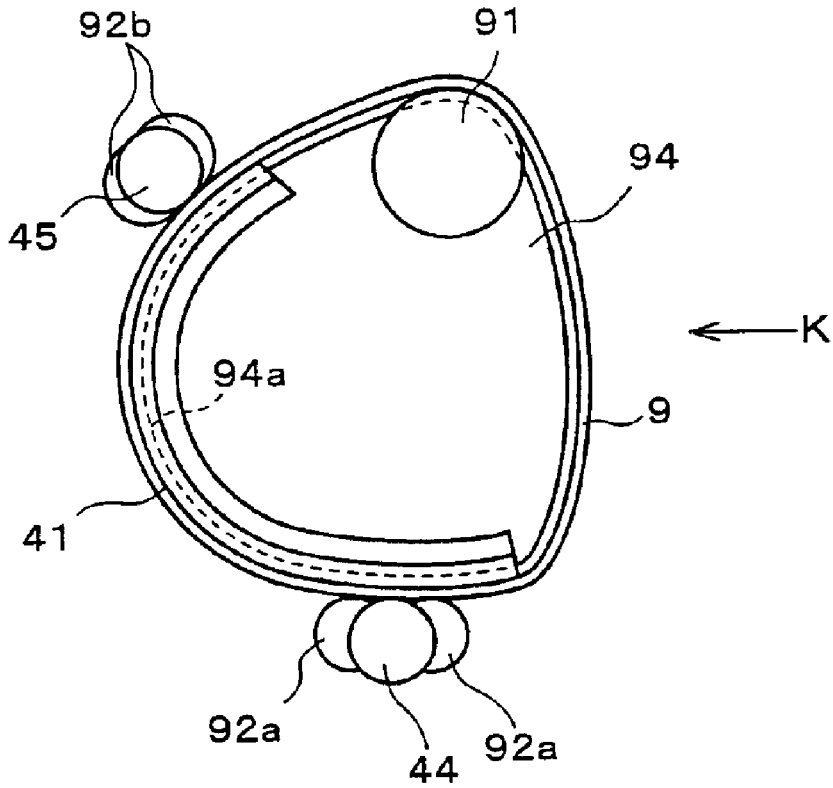
FIG. 8 is a sectional view showing an arrangement around a toner conveying member of the developing device shown in FIG. 7.
Figure 9:
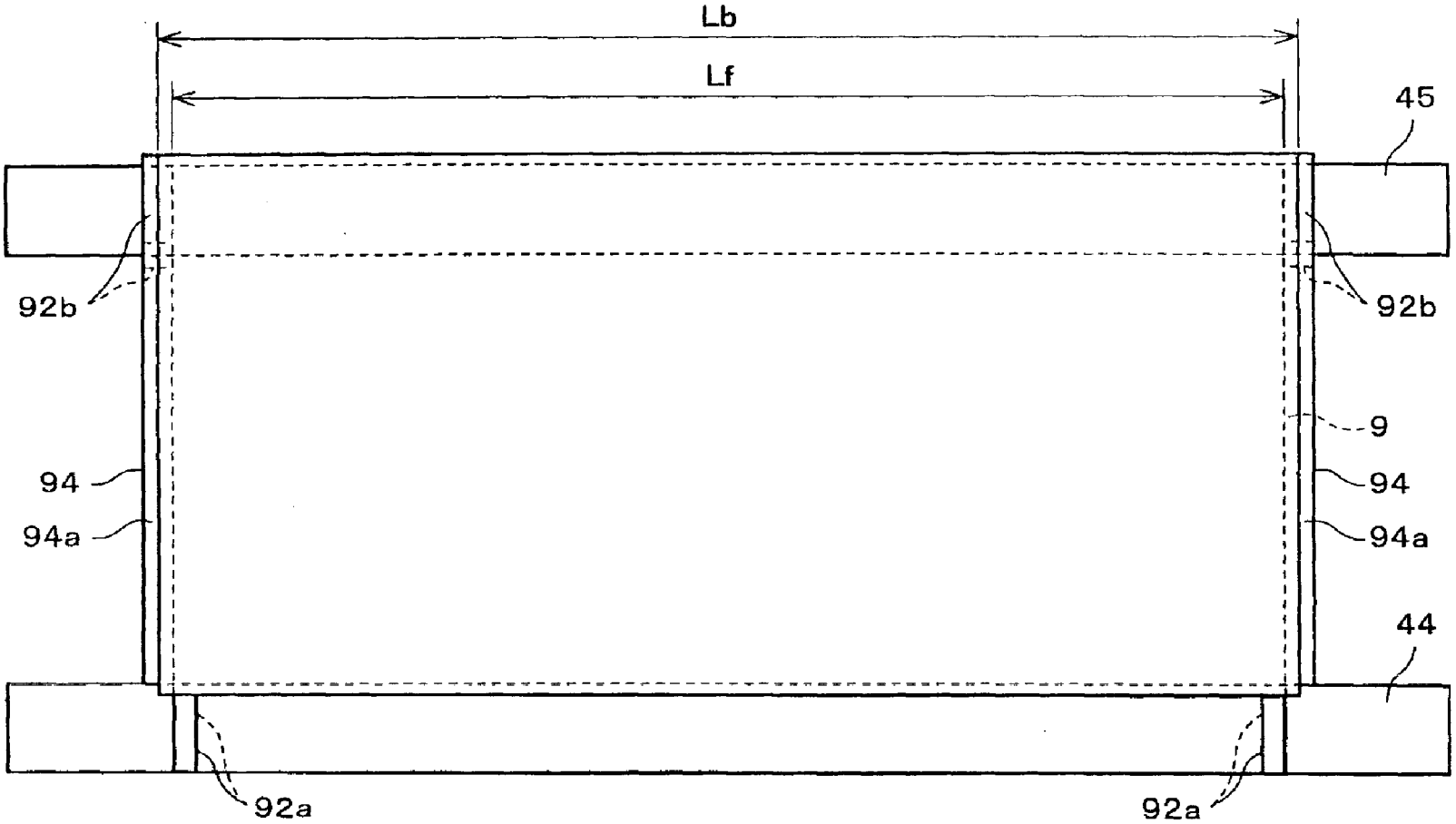
FIG. 9 is a diagram showing the arrangement around the toner conveying member of FIG. 8, which is seen from a direction of the arrow K.

As shown in FIGS. 8 and 9, (iv) a gap Lf between the wiring pattern areas D (including the wiring pattern areas D) outside of the traveling-wave generating electrodes 41*b* in their width direction and (v) a width Lb of the endless belt 9, the width Lb (in the horizontal direction in FIG. 9) being orthogonal to the direction of conveying the toner, are set to satisfy the relation of:

$$Lf \leqq Lb.$$

The supplying member 44 contacts the endless belt 9 at the toner exiting area B. The seal member 92*a* for sealing the toner T is provided at each of both the edges of the toner existing area B in the width direction on the supplying member 44. Likewise, the collecting member 45 contacts the endless belt 9 at the toner existing area E. The seal member 92*b* for sealing the toner T is provided at each of both the edges of the toner existing area E in the width direction on the collecting member 45. The seal member 92*a* is arranged at each of both the sides of the supplying member 44 to be paired with respect to the rotating direction, and the seal member 92*b* is arranged at each of both the sides of the collecting member 45 to be paired with respect to the rotating direction, so as to respectively sandwich the contacting portion where the supplying member 44 or the collecting member 45 contacts the endless belt 9.

At an outside of the endless belt 9 on a back surface side of the toner conveying member 41 (a right side in FIG. 7) that faces the toner T inside the casing 40, a toner wall 93 of a substantially circular arc is provided for preventing the endless belt 9 from directly contacting the toner T inside the casing 40.

Further, on each of both the sides of the endless belt 9 in the width direction, a toner entrance preventing wall 94 (developer entrance preventing wall) is provided so as to contact an inner circumferential surface of the endless belt 9 for preventing the toner T from entering the inner circumferential surface side of the endless belt 9. A peripheral portion of the toner entrance preventing wall 94, namely a portion that contacts the endless belt 9, is composed of an elastic body 94*a*.

In this case, the width Lt of the toner existing area B on the supplying member 44 and the effective electrode width Le of the respective traveling-wave generating electrodes 41*b* are set so as to satisfy the relation of Lt<Le, so that the width Lt of the toner existing area B on the supplying member 44 is smaller than the effective electrode width Le of the respective traveling-wave generating electrodes 41*b*.

Namely, in Embodiment 2, the width Lb of the endless belt 9 is larger than the gap Lf between the wiring pattern areas D outside of the traveling-wave generating electrodes 41*b*. This surely prevents the toner T from entering the wiring pattern areas D outside of the traveling-wave generating electrodes 41*b*, so as to surely prevent the scattering and the sticking of the toner T. This also prevents the toner T from entering the inner circumferential surface side of the endless belt 9, so as to stably rotate the endless belt 9 by preventing the toner T from lowering the driving force of the endless belt 9, thereby conveying the toner T in a stable state. Further, the toner T that is conveyed within the effective electrode width Le can be collected by the collecting member 45 without accumulating.

Further, the width Lt of the toner existing area B on the supplying member 44 is smaller than the effective electrode width Le of the respective traveling-wave generating electrodes 41*b*. This prevents the toner T from entering the inner circumferential surface side of the endless belt 9, thereby further preventing the lowering of the driving force of the endless belt 9, the disturbance of the traveling-wave electric field, etc. caused by the toner T.

Further, the supplying member 44 contacts the endless belt 9 at the toner existing area B. At each of both the edges of the toner existing area B in the width direction on the supplying member 44, the seal member 92*a* is provided to be paired with respect to the rotating direction of the supplying member 44, so as to sandwich the contacting portion where the supplying member 44 contacts the endless belt 9. This prevents the supplied toner T from avalanching into the inner circumferential surface side of the endless belt 9.

Further, the collecting member 45 contacts the endless belt 9 at the toner existing area E. At each of both the edges of the toner existing area E in the width direction on the collecting member 45, the seal member 92*b* is provided to be paired with respect to the rotating direction of the collecting member 45, so as to sandwich the contacting portion where the collecting member 45 contacts the endless belt 9. This prevents the conveyed toner T from avalanching into the inner circumferential surface side of the endless belt 9.

Further, on each of both the sides of the endless belt 9 in the width direction, the toner entrance preventing wall 94 is provided so as to contact the inner circumferential surface of the endless belt 9 for preventing the toner T from entering the inner circumferential surface side of the endless belt 9. This surely prevents the toner T from entering the inner circumferential surface side of the endless belt 9 in a case such that the toner T is scattered or defectively collected.

This surely prevents the lowering of the driving force of the endless belt 9 caused by the toner T, so as to stably rotate the endless belt 9 smoothly, thereby conveying the toner T in a stable state.

Further, the (peripheral) portion of the toner entrance preventing wall 94 that contacts the endless belt 9 is composed of the elastic body 94*a*. This effectively prevents the deterioration of the endless belt 9 caused by the contact with the toner entrance preventing wall 94.

Note that, in Embodiment 2, the gap Lf between the wiring pattern areas D outside of the traveling-wave generating electrodes 41*b* in their width direction and the width Lb of the endless belt 9 are set to satisfy the relation of $Lf \leqq Lb$; the effective electrode width Le of the respective traveling-wave generating electrodes 41*b* in their width direction and the width Lt of the toner existing area B on the supplying member 44 are set so as to satisfy the relation of $Lt < Le$; the seal member 92*a* is provided at each of both the edges of the toner existing area B in the width direction on the supplying member 44; the seal member 92*b* is provided at each of both the edges of the toner existing area E in the width direction on the collecting member 45; and the toner entrance preventing wall 94 is provided on each of both the sides of the endless belt 9 in the width direction. However, the conditions may be set in any combination, as long as at least the effective electrode width Le of the respective traveling-wave generating electrodes 41*b* in their width direction and the width Lt of the toner existing area B on the supplying member 44 are set so as to satisfy the relation of $Lt < Le$.

Note that, as described in the above embodiments, the present invention is not limited to the arrangement for the electrostatic latent image which is optical information written on the photosensitive drum charged by applying predetermined charges. The present invention may be applied to an arrangement in which a static charge latent image is directly formed on a dielectric, such as an ion flow method; and an arrangement in which a predetermined voltage is applied to an electrode having a plurality of openings so as to form an electrostatic image in a space and blow the developer to a recording medium for direct image forming, such as a toner jet method.

As described above, the width Lt of the developer existing area on the supplying member is smaller than the effective electrode width Le of the respective electrodes in their width direction. This prevents the developer from entering the wiring pattern areas outside of the electrodes in their width direction, thereby surely preventing the scattering and the sticking of the developer in the areas.

Here, the width Lr of the collecting member is larger than the effective electrode width Le of the respective electrodes in their width direction, so that the collecting member can surely collect the developer conveyed within the effective electrode width Le, thereby preventing the developer from accumulating in the developer existing area on the developer conveying member.

Further, the wall is provided at respective boundaries of (a) the developer conveying area on the developer conveying member and (b) the wiring patterns outside of the electrodes in their width direction, for parting the area (a) from the areas (b). This blocks the developer that is conveyed in the developer conveying area so as not to enter the wiring pattern areas, thereby surely preventing the scattering and the sticking of the developer from occurring.

Likewise, in the mechanism in which the surface of the developer conveying member is covered with the endless belt that is driven at a very slow speed on the surface of the developer conveying member, the relation among Le, Lt, and Lr is retained. This prevents the developer from entering the wiring pattern areas, so as to surely prevent the scattering and the sticking of the developer in the areas; and allows the collecting member to surely collect the developer that is conveyed within the effective electrode width Le without accumulating. Further, the width Lt of the developer existing area on the supplying member is smaller than the effective electrode width Le of the respective electrodes. This prevents the developer from entering the inner circumferential surface side of the endless belt, so as to further prevent the lowering of the driving force of the endless belt caused by the developer, or the disturbance of the traveling-wave electric field.

Here, the width Lb of the endless belt is larger than the gap Lf between the wiring pattern areas outside of the electrodes in their width direction. This prevents the developer from entering the inner circumferential surface side of the endless belt, so as to stably rotate the endless belt by preventing the developer from lowering the driving force of the endless belt, thereby conveying the developer in a stable state.

Further, by providing the seal member at each of both the edges of the developer existing area in the width direction on the supplying member, it is possible to prevent the developer from entering the wiring pattern areas outside of the electrodes, thereby surely preventing the scattering and the sticking of the developer.

Further, the seal member is provided at each of both the edges of the developer existing area in the width direction on the collecting member. This prevents the developer from avalanching into the inner circumferential surface side of the endless belt, for achieving the stable rotation of the endless belt, thereby conveying the developer in a stable state. Further, this also prevents the developer from entering the wiring pattern areas outside of the electrodes in a case such that the developer is defectively collected on the developer conveying member, thereby surely preventing the scattering and the sticking of the developer.

Further, on each of both the sides of the endless belt in the width direction, the developer entrance preventing wall for sealing is provided so as to contact the inner circumferential surface side. This surely prevents the developer from entering the inner circumferential surface side of the endless belt, so as to stably rotate the endless belt smoothly without causing the lowering of the driving force, thereby conveying the developer in a more stable state.

In particular, the respective contacting portions of the developer entrance preventing wall and the endless belt are composed of the elastic body, thereby effectively preventing the deterioration of the endless belt.

Further, by adapting the above-described developing device in the image forming apparatus, it is possible to provide an image forming apparatus capable of preventing the developer from entering the wiring pattern areas outside of the electrodes, thereby surely preventing the scattering and the sticking of the developer.

According to the developing device as explained in Embodiments 1 and 2, it is possible to surely prevent the scattering and the sticking of the developer. The following Embodiments 3 and 4 will explain further developing devices capable of surely preventing the scattering and the sticking of the developer.

More specifically, in the developing device explained in Embodiments 1 and 2, the direction of rotating the photosensitive drum 1 is set to be opposite to the direction of conveying the toner by the toner conveying member 41. With this, the moving speed of the developer in the developing area that faces the photosensitive drum is relatively fast with respect to the moving speed of the photosensitive drum, thereby increasing a collision energy for landing the developer on the photosensitive drum. As a result, when the developer lands at a portion on the photosensitive drum where the developer has already existed, the scattering of the developer may occur.

Thus, in Embodiments 3 and 4, the direction of rotating the photosensitive drum 1 is set to be the same as the direction of conveying the toner by the toner conveying member 41. With this, the moving speed of the developer in the developing area that faces the photosensitive drum is relatively slow with respect to the moving speed of the photosensitive drum, thereby decreasing the collision energy for landing the developer on the photosensitive drum. As a result, when the developer lands at a portion on the photosensitive drum where the developer has already existed, the scattering of the developer does not occur.

[Embodiment 3]

The following will explain a further embodiment of the present invention. Note that, an image forming apparatus in accordance with the present embodiment is the same as the image forming apparatus of Embodiment 1 except the direction of rotating the photosensitive drum 1 and the direction of conveying the toner by the toner conveying member 41. Since the structure members for composing the image forming apparatus are the same as those of Embodiment 1, identical numbers with those used in Embodiment 1 are assigned, thus their explanation is omitted here.

Figure 10:
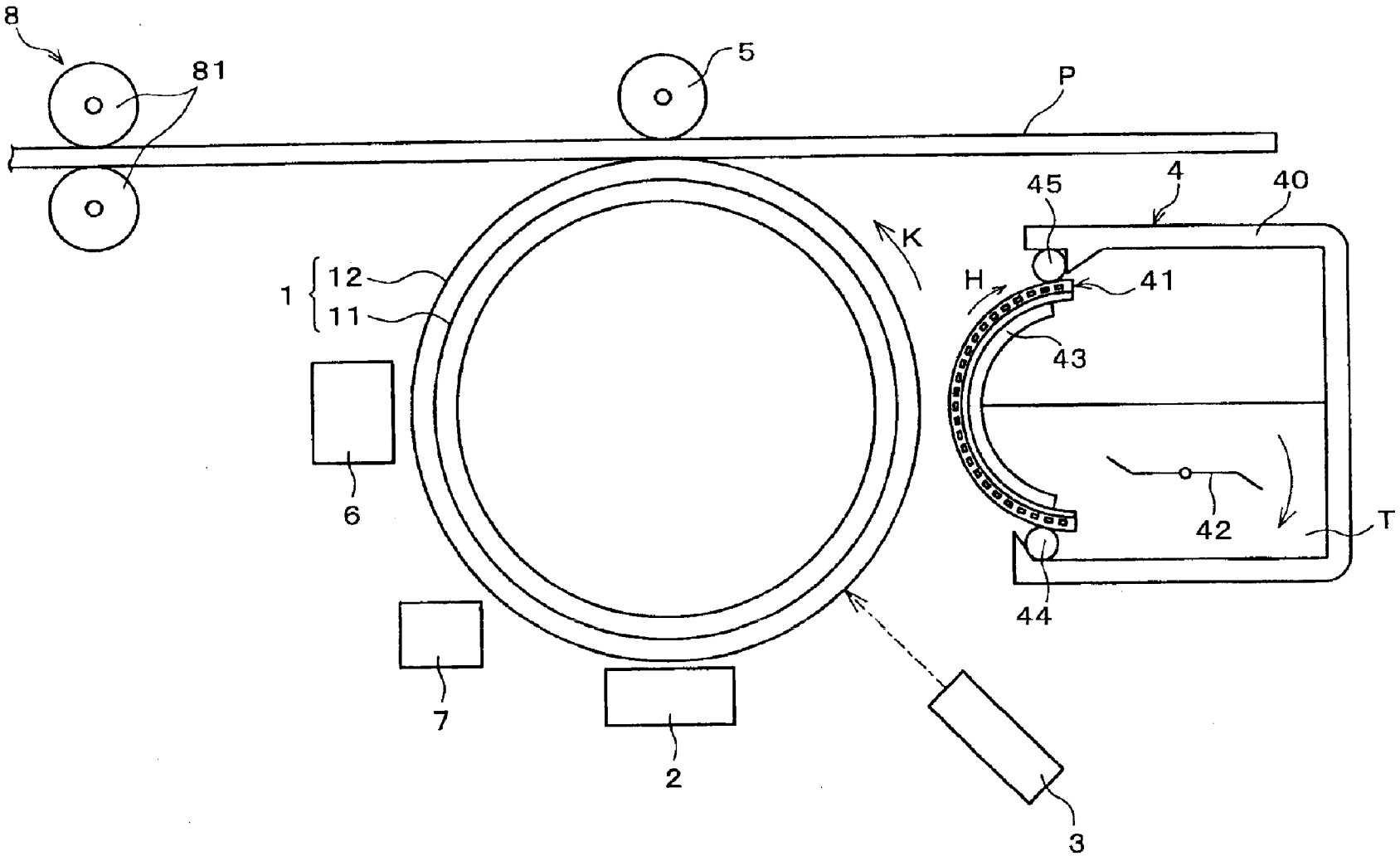
FIG. 10 is a diagram schematically showing an image forming apparatus employing an electrophotography method, which adapts a developing device in accordance with Embodiment 3 of the present invention.
Figure 11:
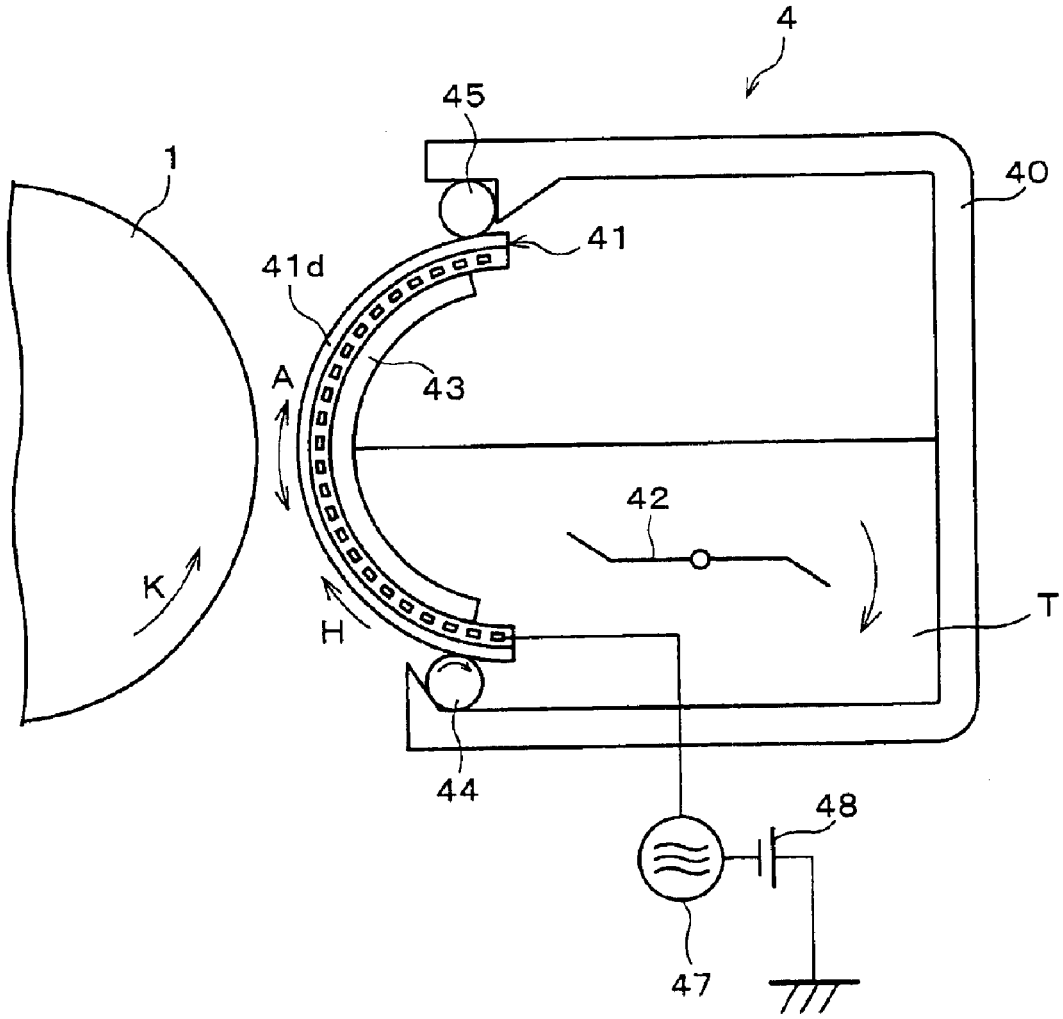
FIG. 11 is a diagram schematically showing an arrangement of the developing device shown in FIG. 10.

Namely, in FIGS. 10 and 11, the photosensitive drum 1 rotates in a direction of the arrow K. The toner conveying member 41 that faces the photosensitive drum 1 conveys the toner T in a direction of the arrow H so as to be the same as the direction of rotating the photosensitive drum 1.

Here, the following will explain the details of the operation of the toner conveying member 41.

Figure 12:
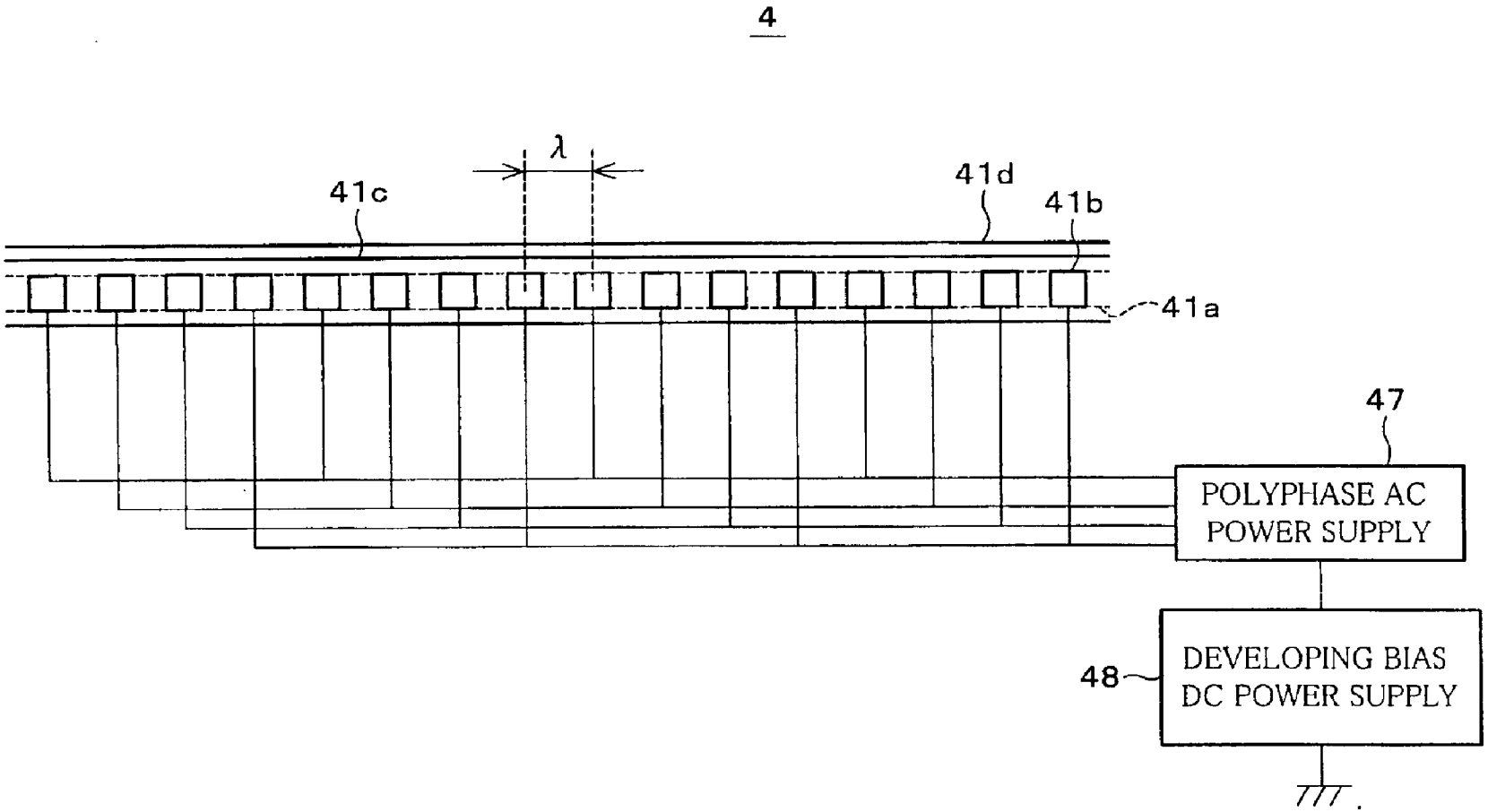
FIG. 12 is a diagram schematically showing an arrangement of a toner conveying member of the developing device shown in FIG. 10.

The toner conveying member 41 conveys the toner T using the electric field curtain effect. As shown in FIG. 12, in the toner conveying member 41, the plural set of four traveling-wave generating electrodes 41*b* for generating the electric field curtain effect are sequentially provided on the substrate 41*a* that is composed of an insulation layer. An insulation layer 41*c* covers a surface side of the toner conveying member 41. Further, a surface of the insulation layer 41*c* is covered with a surface protection layer 41*d*.

Then, the polyphase AC power supply 47 for toner conveyance applies a polyphase AC voltage to these electrodes 41*b*, so as to generate the electric field curtain in a direction parallel to the surface of the toner conveying member 41, thereby conveying the toner T to the developing area A using the electric field curtain effect. In this case, each of the traveling-wave generating electrodes 41*b* is a microelectrode having a width of 40 $\mu$m through 250 $\mu$m, and the traveling-wave generating electrodes 41*b* are respectively provided in parallel to one another with a pitch of 50 dpi (dot per inch) through 300 dpi, namely approximately 500 $\mu$m through 85 $\mu$m.

Figure 13:
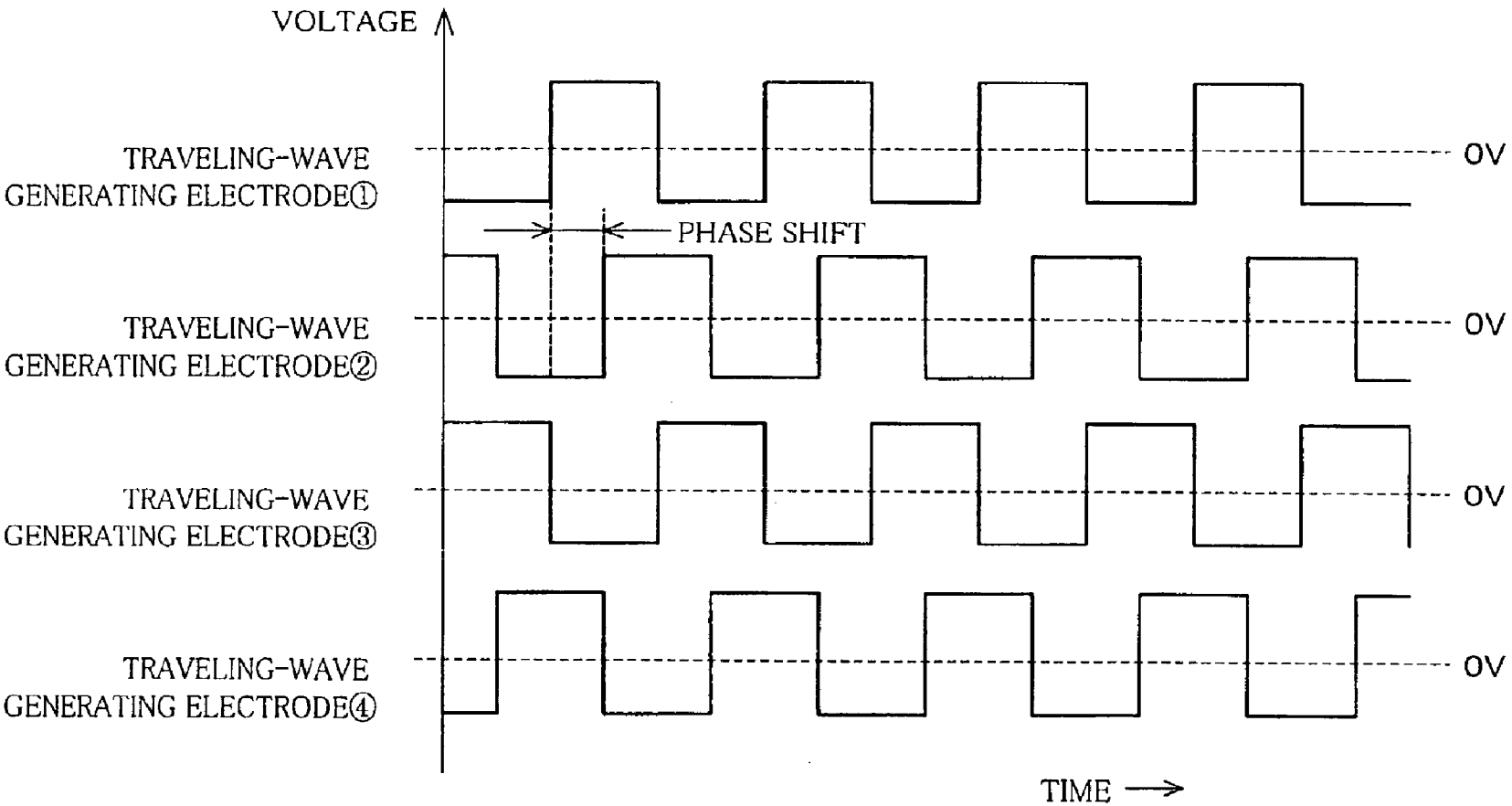
FIG. 13 is a waveform chart showing waveforms of voltages applied on the toner conveying member of the developing device shown in FIG. 10.

As a concrete example, the toner conveying member 41 may be arranged so that the substrate 41*a* is made of polyimide (having a thickness of 25 $\mu$m), the traveling-wave generating electrode 41*b* is made of copper (having a thickness of 18 $\mu$m), and the insulation layer 41*c* is made of polyimide (having a thickness of 25 $\mu$m). Note that, in the present embodiment, four-phase alternating voltages having voltage waveforms as shown in FIG. 13, for example, are respectively applied to the set of four traveling-wave generating electrodes 41*b*, so as to generate a traveling-wave electric field on the traveling-wave generating electrodes 41*b*, but the present invention is not particularly limited to this arrangement. Three-phase alternating voltages may be applied to a set of three traveling-wave generating electrodes.

Further, it is preferable that a bias voltage (developing bias) is applied so as to form a developing electric field between the photosensitive drum 1 and the toner conveying member 41. The material of the surface protection layer 41*d* may be organic insulation materials such as polyimide, PET (polyethylene terephthalate), polytetrafluoroethylene, polyfluoroethylenepropylene, and PTFE (polytetrafluoroethylene), or carbon black or an ionic conductive material that is dispersed or melted in rubber materials such as silicone, isoprene, and butadiene.

The voltage waveform may be a sine wave, a square wave, a trapezoidal wave, etc. A range of the voltage value is preferably 100V through 3 kV, for example, so as not to generate dielectric breakdown between the respective traveling-wave generating electrodes 41*b*. A range of the frequency is preferably 100 Hz through 5 kHz. Note that, the voltage value and the frequency are not particularly limited, and may be appropriately set in accordance with a shape of the traveling-wave generating electrode elements, a conveying speed of the toner T, a material of the toner T, and the like.

Figure 14:
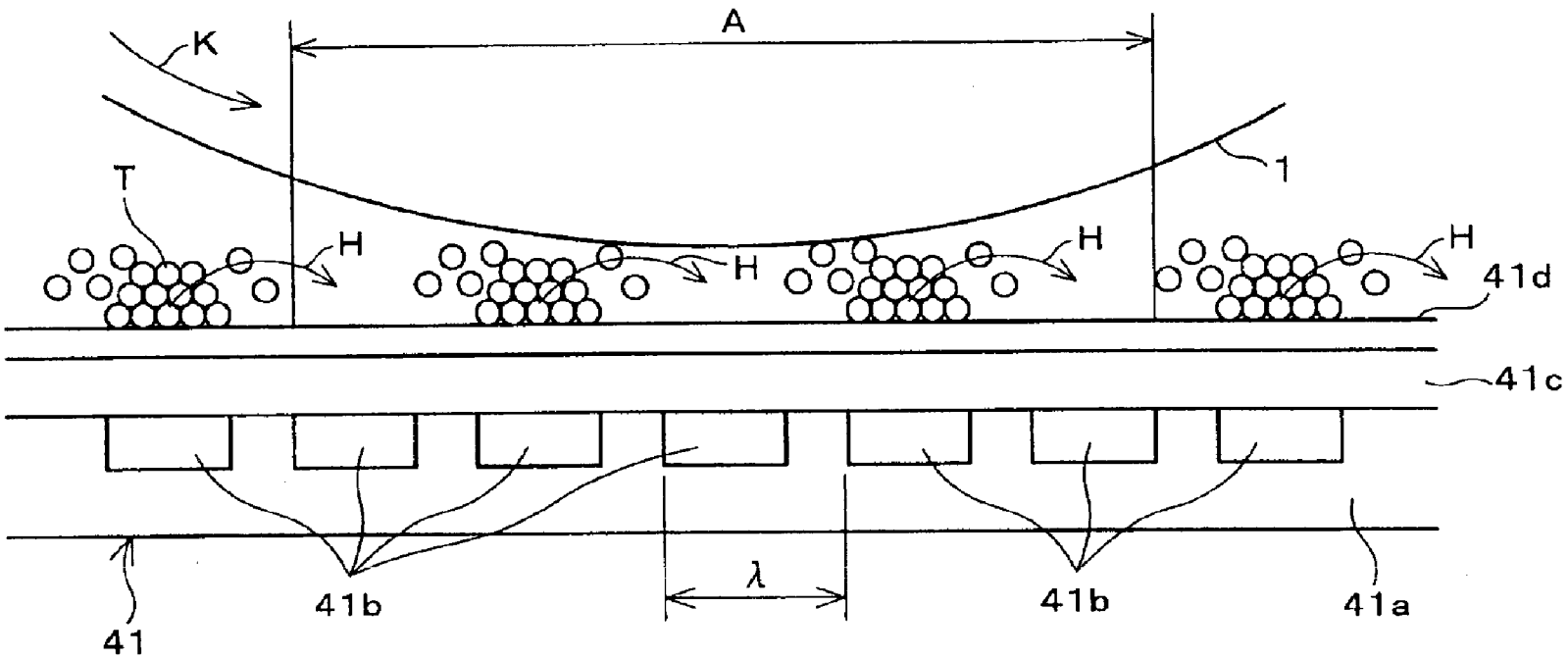
FIG. 14 is an enlarged view showing how toner is conveyed on the toner conveying member of the developing device shown in FIG. 10.

As a characterizing portion of the present invention, as shown in FIG. 14, the direction of conveying the toner T (indicated by the arrow H in FIG. 14) on the toner conveying member 41 (on the surface of the surface protection layer 41*d*) is set to be the same as the direction of rotating the photosensitive drum 1 (counterclockwise direction indicated by the arrow K in FIG. 14) that moves the electrostatic latent image in a circumferential direction. Here, where the speed of rotating the photosensitive drum 1 is K1 (mm/s) and the speed of conveying the toner T is H1 (mm/s), the relative speed of the photosensitive drum 1 with respect to the toner T is K1−H1 (mm/s). For example, when the speed of rotating the photosensitive drum 1 is 200 (mm/s) and the speed of conveying the toner T is 300 (mm/s), the relative speed F of the photosensitive drum 1 with respect to the toner T is 100 (mm/s).

With this, the direction H of conveying the toner T is in the same direction ("with" direction) with the direction K of rotating the photosensitive drum 1 that moves the electrostatic latent image in the circumferential direction. This relatively slows the moving speed of the toner T in the developing area A that faces the photosensitive drum 1 with respect to the speed of rotating the photosensitive drum 1.

This reduces the collision energy for landing the toner T on the photosensitive drum 1. Thus, even when the toner T lands at the portion on the photosensitive drum 1 where the toner T has already existed, the scattering of the toner T does not occur. This eliminates the adverse effect on the image, thereby forming a stable image.

In this case, even when an increased applied voltage is applied to the respective traveling-wave generating electrodes 41*b*, in order to increase an amount of the toner T conveyed on the toner conveying member 41, as well as to reduce the occurrence of the sticking of the toner T, the direction H of conveying the toner T is in the "with" direction with respect to the direction K of rotating the photosensitive drum 1. With this, the moving speed (conveying speed) of the toner T in the developing area A becomes relatively slow with respect to the moving speed (rotating speed) of the photosensitive drum 1, in spite of the fact that the increased applied voltage that is applied to the respective traveling-wave generating electrodes 41*b* increases the speed of conveying the toner T. This enables the toner T to land softly on the photosensitive drum 1 so as to prevent the scattering of the toner T, thereby forming a stable image.

Further, an applied voltage Vpp (V) applied to the respective traveling-wave generating electrodes 41*b* and an interelectrode pitch λ (μm) of the respective traveling-wave generating electrodes 41*b* are set so as to satisfy the relation of $1 \leqq Vpp/\lambda \leqq 6$.

With this, the relation between the applied voltage Vpp and the interelectrode pitch λ can be set in the optimum conditions.

Namely, in a dot reproduction evaluation shown in FIG. 15, when the relation (Vpp/λ) between the applied voltage Vpp and the interelectrode pitch λ is 0.5 which is smaller than 1, the amount of the conveyed toner T is small, and the sticking of the toner T appears much. This results in quite poor property of conveying the toner T with both the counter and "with" rotations.

In this case, as the value Vpp/λ becomes larger than 1, the amount of the conveyed toner T increases and the amount of the stuck toner T decreases. However, when the value Vpp/λ becomes larger than 6, the interelectrode pitch λbecomes relatively smaller than the applied voltage Vpp. This may cause leakage between adjacent traveling-wave generating electrodes 41*b*. Note that, the results shown in FIG. 15 are based on experiment conditions shown in Table 1 below.

TABLE 1

| | | |
|---|---|---|
| toner conveyance conditions | interelectrode pitch | 254 μm |
| | frequency | 1 kHz |
| development conditions | speed of rotating the photosensitive drum | 100 m/s |
| | developing gap | 3 mm |
| | dot | 600 dpi |

Figure 16:
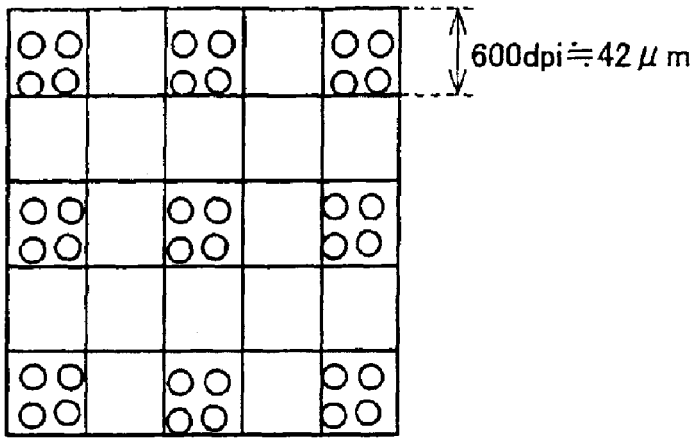
FIG. 16(*a*) is a diagram showing a state in which stable dots are formed with respect to dot scattering.
Figure 16:
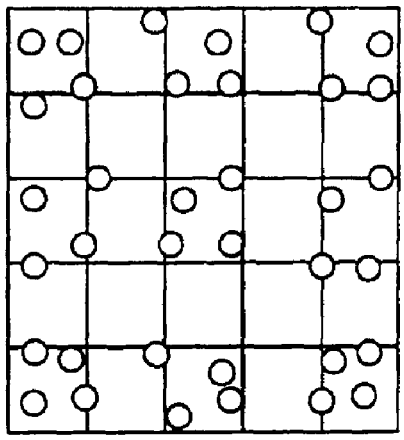
Figure 16:
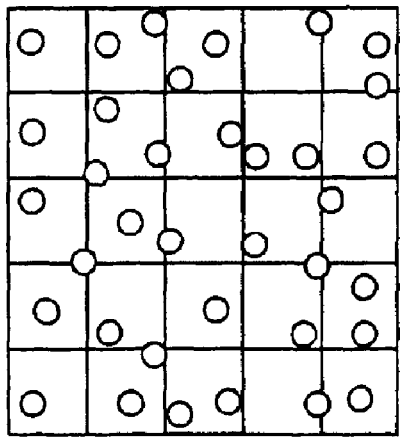

Further, as for dot scattering, a case where stable dots are formed is indicated with "⊙" as shown in FIG. 16(*a*), whereas cases where the images are disturbed to some degree by the scattering caused by the collision of the toner T are indicated with "○" through "×", respectively, as shown in FIGS. 16(*b*) and 16(*c*). As a result, as shown in FIG. 15, as the value Vpp/λ becomes smaller, the image is formed more stably with the both counter and "with" rotations; but it was discovered that the stable image can be formed with respect to a larger value of Vpp/λ with the "with" rotation.

Namely, according to overall judgment showing overall evaluation of the evaluation of both the property of conveying the toner T and the dot scattering, as shown in FIG. 15, by setting the applied voltage Vpp and the interelectrode pitch λ so as to satisfy the relation of $1 \leqq Vpp/\lambda \leqq 6$, it is possible to obtain sufficient density with a sufficient amount of the conveyed toner T, and it is possible to form a stable image with less scattering of the toner T.

Further, by adapting the developing device 4 in the image forming apparatus X, it is possible to provide an image forming apparatus capable of forming a stable image without scattering the toner T on the photosensitive drum 1.

[Embodiment 4]

The following will explain yet another embodiment of the present invention. Note that, in the present embodiment, the developing device is provided with an endless belt as a surface protection layer which is driven at a very slow speed in the direction of conveying the toner on the toner conveying member (on the surface of the insulation layer). Note that, since the structure members other than the endless belt are the same as those of Embodiment 3, identical numbers with those used in Embodiment 3 are assigned, thus their explanation is omitted here.

Figure 17:
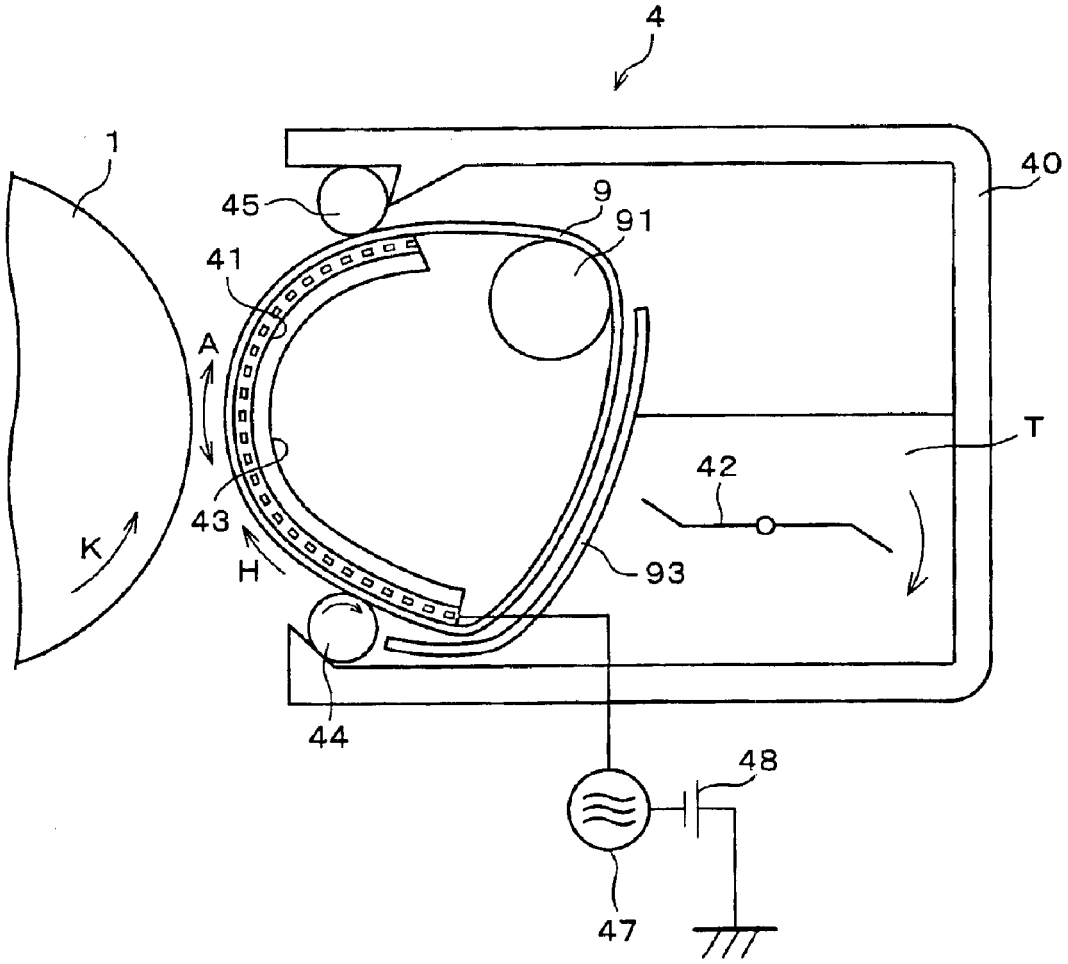
FIG. 17 is a diagram schematically showing an arrangement of a developing device in accordance with Embodiment 4 of the present invention.

Namely, in the present embodiment, as shown in FIG. 17, an endless belt 9 is provided on the surface (counter surface to the photosensitive drum 1) of the toner conveying member 41 so as to cover the surface of the toner conveying member 41 in a circumferential direction. The endless belt 9 is driven at a predetermined peripheral speed by a driving roller 91 that is provided in the casing 40 of the developing device 4.

As described above, by driving the endless belt 9 at the predetermined peripheral speed, the surface of the toner conveying member 41 is continuously cleared, thereby preventing the sticking of the toner T and charging on the surface.

The speed of driving the endless belt 9 is preferably slow such that the endless belt 9 is almost still with respect to the speed of conveying the toner T, and set to be about one-tenth through one-hundredth of the speed of conveying the toner T, for example. In this case, the speed of driving the endless belt 9 can be measured by providing two infrared sensors so as to respectively detect time when the toner T reaches, or by using a high-speed video camera, for example.

Further, predetermined tension is applied to the endless belt 9 so as to closely contact the surface of the toner conveying member 41, so that the traveling-wave electric field (electric field curtain) formed by the traveling-wave generating electrodes 41*b* uniformly effects the surface of the toner conveying member 41.

The applicable endless belt 9 may be organic insulation materials such as polyimide, PET (polyethylene terephthalate), polytetrafluoroethylene, polyfluoroethylenepropylene, and PTFE (polytetrafluoroethylene), and rubber materials such as silicone, isoprene, and butadiene. The thickness of the endless belt 9 may depend on an interelectrode pitch of the toner conveying member 41, but is preferably 5 $\mu$m through 200 $\mu$m, and more preferably 10 $\mu$m through 100 $\mu$m.

Further, the driving roller 91 may be a metal roller member such as SUS and iron, or the metal roller member as a core whose surface is coated with a member such as rubber, film, and sponge. Further, at an outside of the endless belt 9 on a back surface side of the toner conveying member 41 (a right side in FIGS. 17 and 18) that faces the toner T inside the casing 40, a toner wall 93 of a substantially circular arc is provided for preventing the endless belt 9 from directly contacting the toner T inside the casing 40.

The supplying member 44 supplies the toner T to be conveyed on the surface of the endless belt 9, whereas the collecting member 45 collects the toner T on the surface of the endless belt 9.

Then, the polyphase AC power supply 47 applies the polyphase AC voltage to the respective traveling-wave generating electrodes 41*b*, so as to generate the electric curtain on the endless belt 9 in a direction parallel to the endless belt 9, thereby conveying the toner T to the developing area A using the electric field curtain effect.

In this case, even when the toner T is stuck on the surface of the toner conveying member 41, the toner is moved by the endless belt 9 which is driven at a very slow speed on the surface of the toner conveying member 41. Thus, even when the conveyance of the toner T stops at an area directly above the toner conveying member 41, the endless belt 9 conveys the toner T to an area having strong electric field intensity so as to resume the conveyance, thereby smoothly conveying the toner T.

Figure 18:
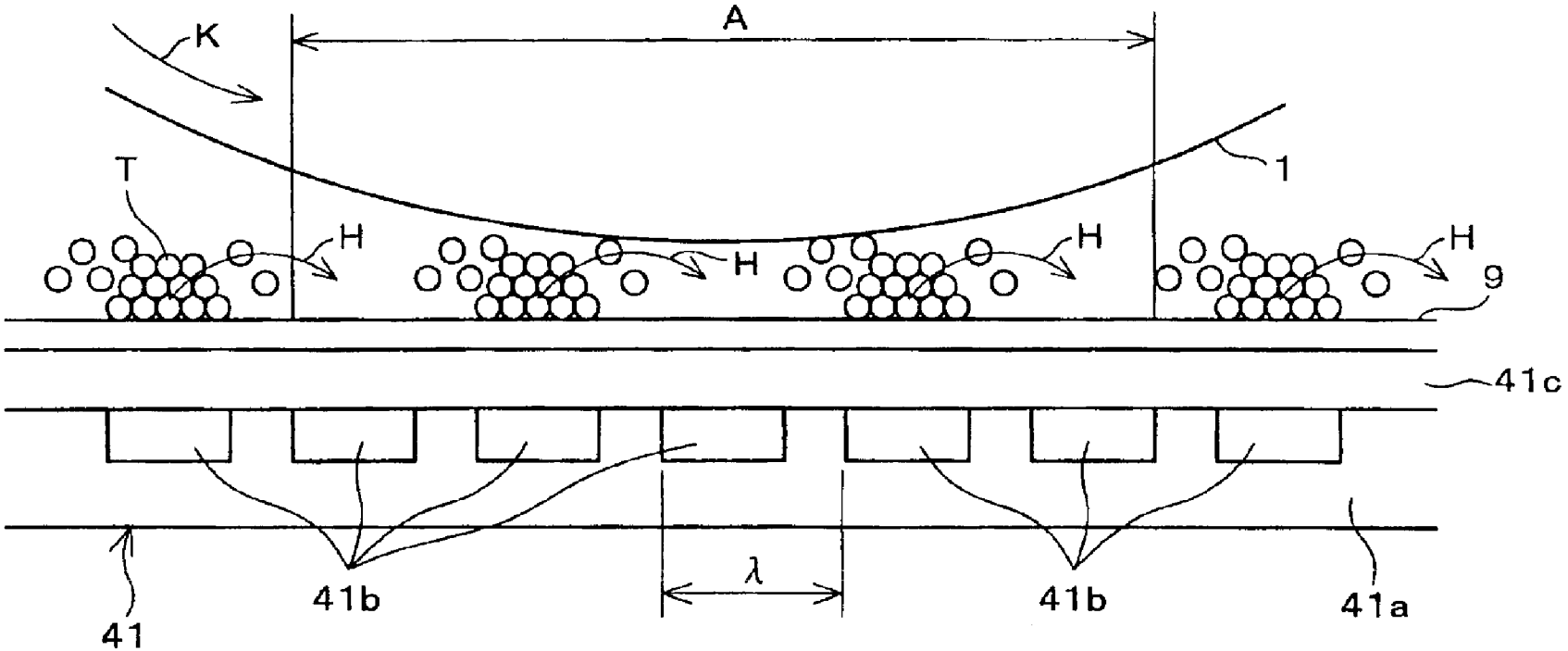
FIG. 18 is an enlarged view showing how toner is conveyed on a toner conveying member of the developing device shown in FIG. 17.

Further, as shown in FIG. 18, the direction of driving the endless belt 9 that is driven on the toner conveying member 41 (counterclockwise direction indicated by the arrow V in FIG. 18) is set to be the same as the direction of conveying the toner T on the endless belt 9 (indicated by the arrow H in FIG. 18) and the direction of rotating the photosensitive drum 1 (counterclockwise direction indicated by the arrow K in FIG. 18).

With this, the direction H of conveying the toner T is in the same direction ("with" direction) with the direction V of driving the endless belt 9 and the direction K of rotating the photosensitive drum 1. This relatively slows the moving speed of the toner T on the endless belt 9 in the developing area A that faces the photosensitive drum 1 with respect to the speed of rotating the photosensitive drum 1. This reduces the collision energy for landing the toner T on the photosensitive drum 1. Thus, even when the toner T lands at the portion on the photosensitive drum 1 where the toner T has already existed, the scattering of the toner T does not occur. This eliminates the adverse effect on the image, thereby forming a stable image.

Further, by setting the applied voltage Vpp (V) that is applied to the respective traveling-wave generating electrodes 41*b* and the interelectrode pitch $\lambda$ ($\mu$m) between the respective traveling-wave generating electrodes 41*b* so as to satisfy the relation of $1 \leqq Vpp/\lambda \leqq 6$, it is possible to obtain sufficient density with a sufficient amount of the conveyed toner T, and it is possible to form a stable image with less scattering of the toner T.

Note that, as described in the above embodiments, the present invention is not limited to the arrangement for the electrostatic latent image which is optical information written on the photosensitive drum charged by applying predetermined charges. The present invention may be applied to an arrangement in which a static charge latent image is directly formed on a dielectric, such as an ion flow method; and an arrangement in which a predetermined voltage is applied to an electrode having a plurality of openings so as to form an electrostatic image in a space and blow the developer to a recording medium for direct image forming, such as a toner jet method.

As described above, by conveying the developer in the "with" direction with respect to the direction of moving the image carrying body, the moving speed of the developer in the developing area that faces the image carrying body becomes relatively slow with respect to the moving speed of the image carrying body. This decreases the collision energy for landing the developer on the image carrying body. This consequently prevents the adverse effect on the image caused by the scattering of the developer, thereby forming a stable image. Further, in spite of the fact that the increased applied voltage applied to the respective electrodes increases the speed of conveying the developer, the moving speed of the developer in the developing area becomes relatively slow with respect to the moving speed of the image carrying body. This enables the developer to land softly on the image carrying body so as to prevent the scattering of the developer, thereby forming a stable image.

In particular, by setting the value Vpp/$\lambda$, which is obtained by dividing the applied voltage Vpp that is applied to the respective electrodes by the interlectrode pitch $\lambda$ ($\mu$m), so as to satisfy the relation of $1 \leqq Vpp/\lambda \leqq 6$, it is possible to obtain sufficient density with a sufficient amount of the conveyed developer, and it is possible to form a stable image with less scattering of the developer.

Further, by adapting the above-described developing device in the image forming apparatus, it is possible to provide a developing device capable of forming a stable image without scattering the developer on the image carrying body, and an image forming apparatus adapting the same.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

INDUSTRIAL APPLICABILITY

With the developing device of the present invention, the width Lt of the developer existing area on the supplying member (the width Lt is orthogonal to the arranging direction of the respective electrodes) is smaller than the effective electrode width Le of the respective electrodes in their width direction (orthogonal to their arranging direction). This prevents the developer from entering the wiring pattern areas respectively provided outside of the electrodes in their width direction, thereby surely preventing the scattering and the sticking of the developer in the areas.

Here, the developing device may be further provided with a collecting member for collecting the developer that is conveyed on the developer conveying member, wherein (iii) a width Lr of the collecting member, the width Lr being orthogonal to a direction of collecting the developer, and (i) the effective electrode width Le of the respective electrodes in their width direction are set so as to satisfy a relation of $Le \leqq Lr$. With the width Lr of the collecting member which is larger than the effective electrode width Le of the respective electrodes, the collecting member can surely collect the developer that is conveyed within the effective electrode width Le, thereby preventing the developer from accumulating in the developer conveying area on the developer conveying member.

Further, when a wall is provided at respective boundaries of (a) a developer conveying area that is located between the supplying position and the collecting position of the developer on the developer conveying member and (b) wiring pattern areas that are respectively provided outside of the electrodes in the width direction of the electrodes orthogonal to the arranging direction of the electrodes, for parting the area (a) from the areas (b), the wall can block the developer that is conveyed in the developer conveying area on the developer conveying member so as not to enter the wiring pattern areas, thereby surely preventing the scattering and the sticking of the developer from occurring.

On the other hand, when a surface of the developer conveying member is covered with an endless belt which is driven at a very slow speed (driven at about an one-tenth through one-hundredth speed of the speed of conveying the developer, for example) on the surface of the developer conveying member, and the developer is conveyed on the endless belt using the traveling-wave electric field that is formed by applying the polyphase voltage to the respective electrodes, it is possible to prevent the developer from entering the wiring pattern areas that are respectively provided outside of the electrodes, so as to surely prevent the scattering and the sticking of the developer in the areas. Further, the developer that is conveyed within the effective electrode width Le can be surely collected by the collecting member without accumulating.

Further, when the width Lt of the developer existing area on the supplying member is smaller than the effective electrode width Le of the respective electrodes, it is possible to prevent the developer from entering the inner circumferential surface side of the endless belt, thereby further preventing the lowering of the driving force of the endless belt, the disturbance of the traveling-wave electric field, etc. caused by the developer.

Here, when (iv) a gap Lf between wiring pattern areas respectively provided outside of the electrodes in the width direction of the electrodes orthogonal to the arranging direction of the electrodes and (v) an width Lb of the endless belt, the width Lb being orthogonal to the direction of conveying the developer, are set so as to satisfy a relation of $Lf \leqq Lb$, the width Lb of the endless belt is larger than the gap Lf between the wiring pattern areas outside of the electrodes in their width direction. This prevents the developer from entering the inner circumferential surface side of the endless belt, so as to stably rotate the endless belt by preventing the developer from lowering the driving force of the endless belt, thereby conveying the developer in a stable state.

Further, when a seal member for sealing the developer is provided at each of both the edges of the developer existing area in the width direction on the supplying member, it is possible to prevent the developer from entering the wiring pattern areas outside of the electrodes, thereby surely preventing the scattering and the sticking of the developer.

Further, a seal member for sealing the developer may be provided at each of both the edges of the developer existing area in the width direction on a collecting member for collecting the developer, the collecting member contacting the endless belt in the developer existing area. With the seal members at the both edges of the developer existing area on the collecting member, it is possible to prevent the conveyed developer from avalanching into the inner circumferential surface side of the endless belt, for achieving the stable rotation of the endless belt, thereby conveying the developer in a stable state.

On the other hand, a seal member for sealing the developer may be provided at each of both the edges of the developer existing area in the width direction on a collecting member for collecting the developer, the collecting member contacting the developer conveying member in the developer existing area. With the seal members at the both edges of the developer existing area on the collecting member, it is possible to prevent the developer from entering the wiring pattern areas outside of the electrodes even when the conveyed developer is defectively collected, thereby surely preventing the scattering and the sticking of the developer.

Further, a toner entrance preventing wall may be provided on each of both the sides of the endless belt in the width direction, so as to contact an inner circumferential surface of the endless belt, for preventing the developer from entering the inner circumferential surface side of the endless belt. With the toner entrance preventing walls on the both sides of the endless belt in the width direction, which contact the inner circumferential surface of the endless belt for sealing, it is possible to surely prevent the developer from entering the inner circumferential surface side of the endless belt in a case such that the developer is scattered or defectively collected. This surely prevents the developer from lowering the driving force of the endless belt, so as to stably rotate the endless belt smoothly, thereby conveying the developer in a more stable state.

In particular, when a portion of the developer entrance preventing wall that contacts the endless belt is composed of an elastic body, it is possible to effectively prevent the deterioration of the endless belt caused by the contact with the toner entrance preventing wall.

Further, when the above-described developing device is adapted in an image forming apparatus, it is possible to provide an image forming apparatus capable of preventing the developer from entering the wiring pattern areas outside of the electrodes, thereby surely preventing the scattering and the sticking of the developer.

Further, according to the developing device of the present invention, since the developer is conveyed in the same direction ("with" direction) with respect to the direction of moving the image carrying body that moves the electrostatic latent image in the circumferential direction, the moving speed of the developer in the developing area that faces the image carrying body becomes relatively slow with respect to the moving speed of the image carrying body. This decreases the collision energy for landing the developer on the image carrying body. Thus, even when the developer lands at the portion on the image carrying body where the developer has already existed, the scattering of the developer does not occur. This eliminates the adverse effect on the image, thereby forming a stable image.

Further, when the applied voltage applied to the respective electrodes is increased for increasing an amount of the developer conveyed on the developer conveying member and for reducing the occurrence of the sticking of the developer, the developer may be conveyed in the "with" direction with respect to the direction of moving the image carrying body. With this arrangement, in spite of the fact that the increased applied voltage applied to the respective electrodes increases the speed of conveying the developer, the moving speed of the developer in the developing area becomes relatively slow with respect to the moving speed of the image carrying body. This enables the developer to land softly on the image carrying body so as to prevent the scattering of the developer, thereby forming a stable image.

In particular, when an applied voltage Vpp (V) applied to the respective electrodes and an interelectrode pitch $\lambda$ ($\mu$m) of the respective electrodes are set so as to satisfy a relation of $1 \leqq Vpp/\lambda \leqq 6$, the relation between the applied voltage Vpp and the interelectrode pitch $\lambda$ can be set in the optimum conditions.

Namely, when the relation ($Vpp/\lambda$) between the applied voltage Vpp and the interelectrode pitch $\lambda$ is smaller than 1, the amount of the conveyed developer is small, and the sticking of the developer appears much. This results in quite poor property of conveying the developer. In this case, as the value $Vpp/\lambda$ becomes larger than 1, the amount of the conveyed developer increases and the amount of the stuck developer decreases. However, when the value $Vpp/\lambda$ becomes larger than 6, the interelectrode pitch $\lambda$ becomes relatively smaller than the applied voltage Vpp. This may cause leakage between adjacent electrodes.

Thus, by setting the applied voltage Vpp and the interelectrode pitch $\lambda$ so as to satisfy the relation of $1 > Vpp/\lambda \leqq 6$, it is possible to obtain sufficient density with a sufficient amount of the conveyed developer, and it is possible to form a stable image with less scattering of the developer.

Further, when the above-described developing device is adapted in an image forming apparatus, it is possible to provide an image forming apparatus capable of forming a stable image without scattering the developer on the image carrying body.

What is claimed is:

1. A developing device, comprising a developer conveying member in which a plurality of electrodes arranged on a substrate at a predetermined interval are coated with a surface protection layer, said developer conveying member being provided in a developing area that faces an image carrying body whose surface carries an electrostatic latent image, wherein developer is conveyed on said developer conveying member using a traveling-wave electric field that is formed by applying a polyphase voltage to said respective electrodes, the developing device further comprising:

a supplying member for supplying the developer onto said developer conveying member, wherein (i) an effective electrode width Le of said respective electrodes in their width direction orthogonal to their arranging direction and (ii) a width Lt of a developer existing area on said supplying member, the width Lt being orthogonal to a direction of supplying the developer, are set so as to satisfy a relation of $Lt < Le$.

2. The developing device as set forth in claim 1, further comprising a collecting member for collecting the developer that is conveyed on said developer conveying member, wherein:

(iii) a width Lr of said collecting member, the width Lr being orthogonal to a direction of collecting the developer, and the effective electrode width Le of said respective electrodes in their width direction are set so as to satisfy a relation of $Le \leqq Lr$.

3. The developing device as set forth in claim 1, further comprising:

a wall at respective boundaries of (a) a developer conveying area that is located between the supplying position and the collecting position of the developer on said developer conveying member and (b) wiring pattern areas that are respectively provided outside of said electrodes in the width direction of said electrodes orthogonal to the arranging direction of said electrodes, for parting the area (a) from the areas (b).

4. The developing device as set forth in claim 1, further comprising:

a seal member for sealing the developer, at each of both the edges of the developer existing area in the width direction on said supplying member.

5. The developing device as set forth in claim 1, further comprising:

a seal member for sealing the developer, at each of both the edges of the developer existing area in the width direction on a collecting member for collecting the developer, said collecting member contacting said developer conveying member in the developer existing area.

6. The developing device as set forth in claim 1, wherein:

a surface of said developer conveying member is covered with an endless belt which is driven at a very slow speed on the surface of said developer conveying member; and the developer is conveyed on said endless belt using the traveling-wave electric field that is formed by applying the polyphase voltage to said respective electrodes.

7. The developing device as set forth in claim 6, wherein:

(iv) a gap Lf between wiring patterns respectively provided outside of said electrodes in the width direction of said electrodes orthogonal to the arranging direction of said electrodes and a width Lb of said endless belt, the width Lb being orthogonal to the direction of conveying the developer, are set so as to satisfy a relation of $Lf \leqq Lb$.

8. The developing device as set forth in claim 6, wherein:

predetermined tension is applied to said endless belt so as to closely contact the surface of said developer conveying member.

9. The developing device as set forth in claim 6, further comprising:

a seal member for sealing the developer, at each of both the edges of the developer existing area in the width direction on a collecting member for collecting the developer, said collecting member contacting said endless belt in the developer existing area.

10. The developing device as set forth in claim 6, further comprising:

a toner entrance preventing wall on each of both the sides of said endless belt in the width direction, so as to contact an inner circumferential surface of said endless belt, for preventing the developer from entering the inner circumferential surface side of said endless belt.

11. The developing device as set forth in claim 10, wherein:

a portion of said developer entrance preventing wall that contacts said endless belt is composed of an elastic body.

12. A developing device, comprising a developer conveying member in which a plurality of electrodes arranged on a substrate at a predetermined interval are coated with a surface protection layer, said developer conveying member being provided in a developing area that faces an image carrying body whose surface carries an electrostatic latent image, wherein developer is conveyed on said developer conveying member using a traveling-wave electric field that is formed by applying a polyphase voltage to said respective electrodes, wherein:

a direction of conveying the developer is set to be the same as a direction of moving the image carrying body that moves said electrostatic latent image in a circumferential direction; and an applied voltage Vpp (V) applied to said respective electrodes and an interelectrode pitch $\lambda$ ($\mu$m) of said respective electrodes are set so as to satisfy a relation of $1 \leqq Vpp/\lambda \leqq 6$.

13. A developing device, comprising a developer conveying member in which a plurality of electrodes arranged on a substrate at a predetermined interval are coated with a surface protection layer, said developer conveying member being provided in a developing area that faces an image carrying body whose surface carries an electrostatic latent image, wherein developer is conveyed on said developer conveying member using a traveling-wave electric field that is formed by applying a polyphase voltage to said respective electrode, wherein:

a direction of conveying the developer is set to be the same as a direction of moving the image carrying body that moves said electrostatic latent image in a circumferential direction;

a surface of said developer conveying member is covered with an endless belt which is driven at a very slow speed on the surface of said developer conveying member; and the developer is conveyed on said endless belt using the traveling-wave electric field that is formed by applying the polyphase voltage to said respective electrodes.

14. The developing device as set forth in claim 13, wherein:

predetermined tension is applied to said endless belt so as to closely contact the surface of said developer conveying member.

15. An image forming apparatus, comprising:

the developing device as set forth in any one of claims 1–11 and 12–14.

16. The developing device of any of claims 1–11, wherein a direction of conveying the developer is set to be the same as a direction of moving the image carrying body that moves said electrostatic latent image in a circumferential direction.

17. The developing device of claim 16, wherein an applied voltage Vpp (V) applied to said respective electrodes and an interelectrode pitch $\lambda$ ($\mu$m) of said respective electrodes are set so as to satisfy a relation of $1 \leqq Vpp/\lambda \leqq 6$.

* * * * *